US011613405B2

(12) United States Patent
Worthington

(10) Patent No.: US 11,613,405 B2
(45) Date of Patent: Mar. 28, 2023

(54) MODULAR CUBE FOR A VINYL RECORD

(71) Applicant: Paul Stewart Worthington, Hoxton Park (AU)

(72) Inventor: Paul Stewart Worthington, Hoxton Park (AU)

( * ) Notice: Subject to any disclaimer, the term of this patent is extended or adjusted under 35 U.S.C. 154(b) by 0 days.

(21) Appl. No.: 17/523,901

(22) Filed: Nov. 10, 2021

(65) Prior Publication Data

US 2022/0144484 A1 May 12, 2022

Related U.S. Application Data

(60) Provisional application No. 63/111,872, filed on Nov. 10, 2020.

(51) Int. Cl.
*B65D 6/26* (2006.01)
*B65D 6/34* (2006.01)

(52) U.S. Cl.
CPC ..... *B65D 9/22* (2013.01); *B65D 9/34* (2013.01)

(58) Field of Classification Search
CPC ..... B65D 9/22; B65D 9/12; B65D 11/1873; B65D 11/1866
USPC ..... 220/4.28, 4.31–4.33; 206/600
See application file for complete search history.

(56) References Cited

U.S. PATENT DOCUMENTS 3,308,705 A * 3/1967 Shinnick ..... A23G 3/28 428/7
6,497,018 B1 * 12/2002 Chiu ..... A61G 17/004 220/4.28

* cited by examiner

*Primary Examiner* — Ernesto A Grano
*Assistant Examiner* — Symren K Sanghera
(74) *Attorney, Agent, or Firm* — Donald Debelak

(57) ABSTRACT

A modular cube for a vinyl record is an apparatus that stores, organizes, and displays multiple vinyl records. The apparatus includes a plurality of box walls and an interlocking mechanism. In order to create a cube-shape, the plurality of box walls includes a base wall, a cover wall, and a plurality of lateral walls. Each of the plurality of box walls latches with each other and is easily dismantled because of the interlocking mechanism. While connected to one another, the plurality of box walls house multiple vinyl records. In order to display a record casing across a wall of the plurality of lateral walls, the apparatus further includes at least one dowel. In order to further display each record casing and easily access the multiple records housed within the apparatus from any direction, the apparatus further includes a table adapter and a turntable.

19 Claims, 14 Drawing Sheets

MODULAR CUBE FOR A VINYL RECORD

The current application claims a priority to the U.S. Provisional Patent application Ser. No. 63/111,872 filed on Nov. 10, 2020.

FIELD OF THE INVENTION

The present invention generally relates to storage and organization. More specifically, the present invention is a modular cube for a vinyl record. Furthermore, the present invention stores, organizes, and displays multiple vinyl records.

BACKGROUND OF THE INVENTION

Vinyl records are essential for music lovers everywhere. Due to the structure and shape of vinyl records, record casings are essential to protect each vinyl record while not in use and in storage. However, there are not many displays and storage options for vinyl records. Existing means to organize or store vinyl records are inefficient in terms of organization and space utilization, and, especially, are not aesthetically pleasing.

It is therefore an objective of the present invention to store and display a vinyl record. The present invention is a modular cube for a vinyl record. The present invention may house multiple records and each modular cube may individually organize multiple records or multiple modular cubes may organize more records together. The present invention provides easy access for the multiple records. The present invention may be dissembled and remains compact while not in use. The present invention is also aesthetically pleasing, utilizing the record casing as an exterior cover for the present invention.

DETAILED DESCRIPTIONS OF THE INVENTION

Figure 1:
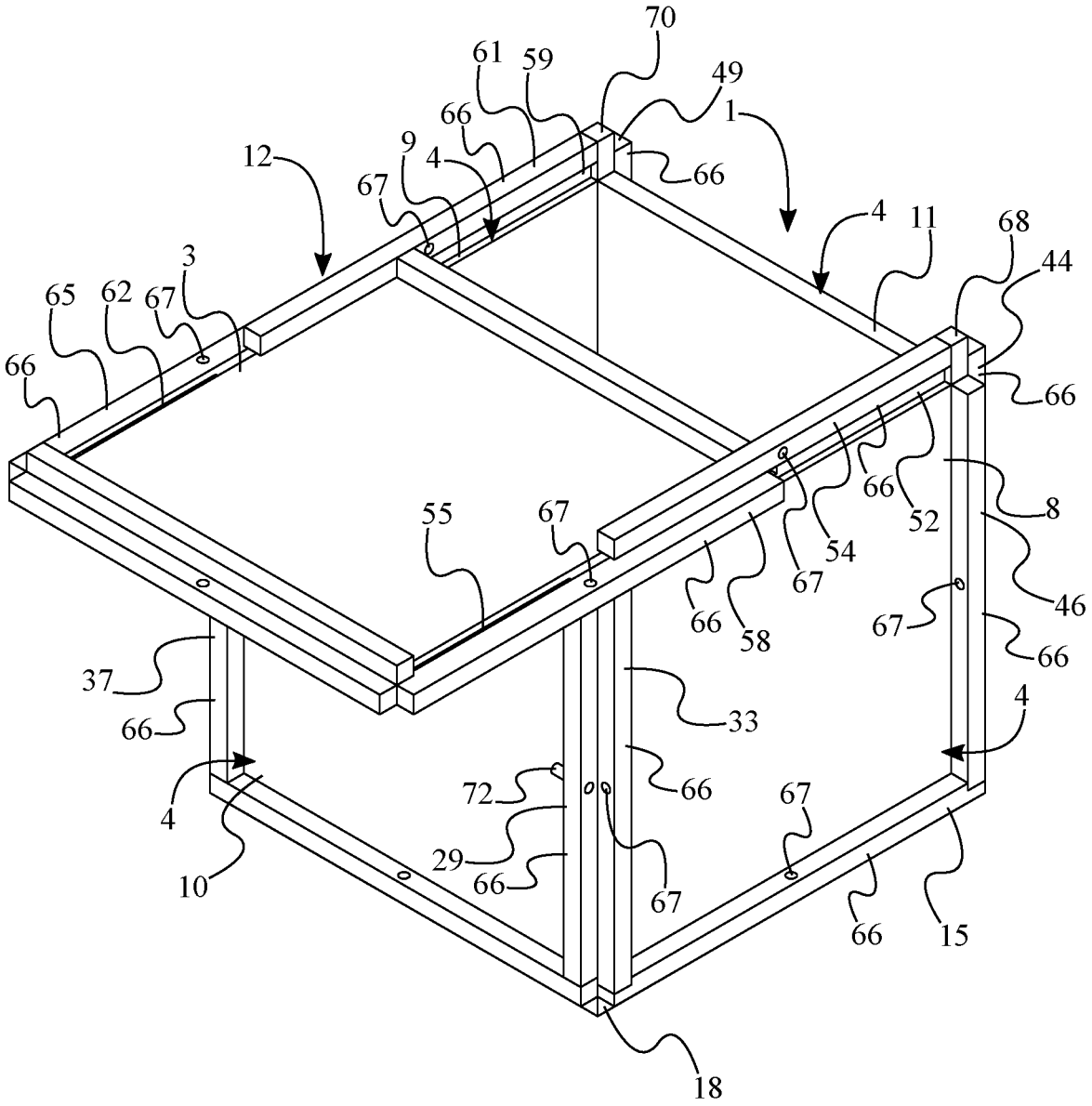
FIG. 1 is a perspective view of the present invention in an opened configuration with a cover wall extended from a rear wall.
Figure 2:
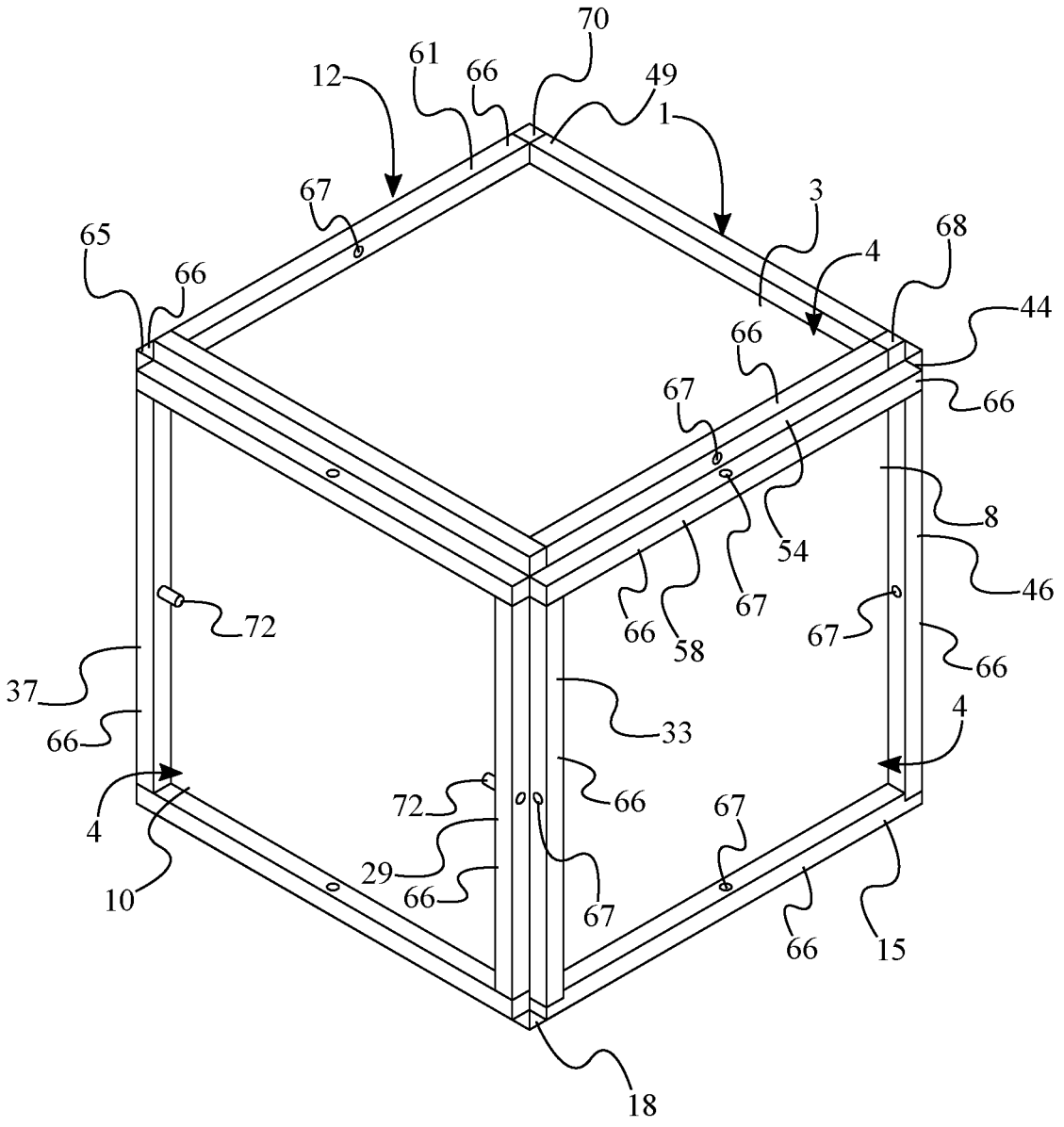
FIG. 2 is a perspective view of the present invention in a closed configuration with the cover wall retracted towards the rear wall.
Figure 3:
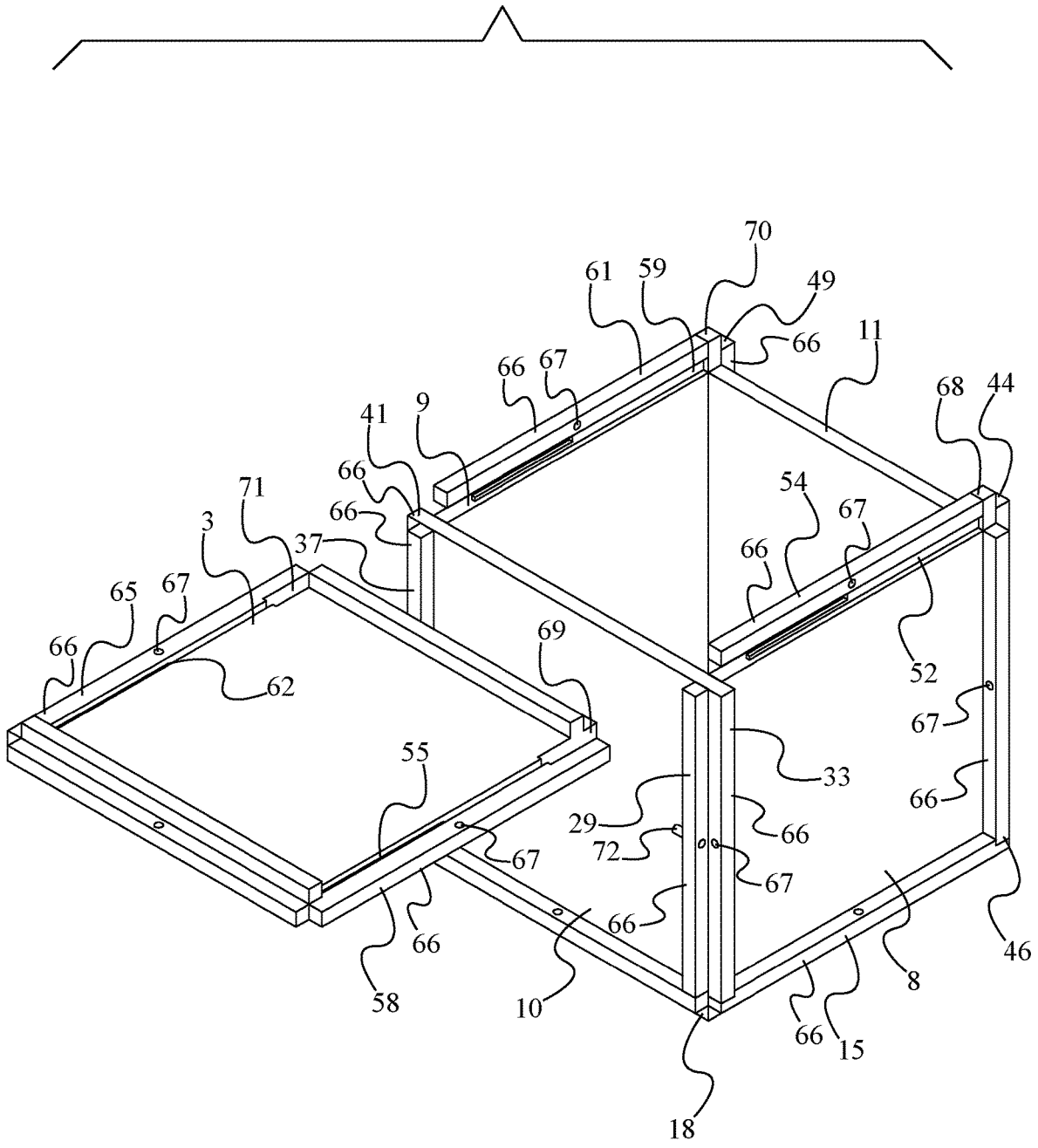
FIG. 3 is a partially exploded view of the present invention with the cover wall separated from a plurality of lateral walls.

All illustrations of the drawings are for the purpose of describing selected versions of the present invention and are not intended to limit the scope of the present invention.

The present invention is a modular cube for a vinyl record. The present invention preferably houses multiple records for storage and organization. The present invention may be dismantled while not in use. A single unit of the present invention may be stacked with another unit of the present invention for further storage and organization. In order for the present invention to remain structurally sound while housing multiple records and to maintain a compact structure while not in use, the present invention comprises a plurality of box walls 1 and an interlocking mechanism 12, seen in FIG. 1, FIG. 2, FIG. 3, FIG. 4, FIG. 5, FIG. 12, FIG. 13, and FIG. 14. The plurality of box walls 1 conceals, upholds, and contains multiple records. The interlocking mechanism 12 attaches each of the plurality of box walls 1 with each other in order to define a cube-shape for the present invention. Moreover, the interlocking mechanism 12 facilitates the engagement and disengagement of each of the plurality of box walls 1 with each other. The cube-shape is defined as the plurality of box walls 1 comprises a base wall 2, a cover wall 3, and a plurality of lateral walls 4. The base wall 2 upholds the multiple records, the cover wall 3 encloses the multiple records, and the plurality of walls surrounds the multiple records. More specifically, each pair of adjacent walls 5 from the plurality of box walls 1 comprises an arbitrary wall 6 and an adjacent wall 7, effectively providing an enclosed environment for the multiple records. In the preferred embodiment of the present invention, the plurality of box walls 1 and the interlocking mechanism 12 are both preferably made of wood material. However, it is understood that the plurality of box walls 1 and the interlocking mechanism 12 may be made of a variety of materials in various embodiments of the present invention.

The overall configuration of the aforementioned components allows the present invention to house and conceal multiple vinyl records and allows the present invention to be completely dissembled while not in use. The multiple records may be positioned within the present invention as the plurality of lateral walls 4 is positioned adjacent and perpendicular with the base wall 2, seen in FIG. 1, FIG. 2, FIG. 3, FIG. 4, FIG. 5, FIG. 12, FIG. 13, and FIG. 14. Moreover, the space to contain multiple records is maximized as the plurality of lateral walls 4 is perimetrically distributed around the base wall 2. The cover wall 3 is positioned adjacent and perpendicular with the plurality of lateral walls 4, opposite to the base wall 2, thereby enclosing the present invention and concealing the multiple records within the present invention. In order to connect each of the plurality of box walls 1 with each other, the arbitrary wall 6 is detachably attached with the adjacent wall 7 by the interlocking mechanism 12.

Figure 4:
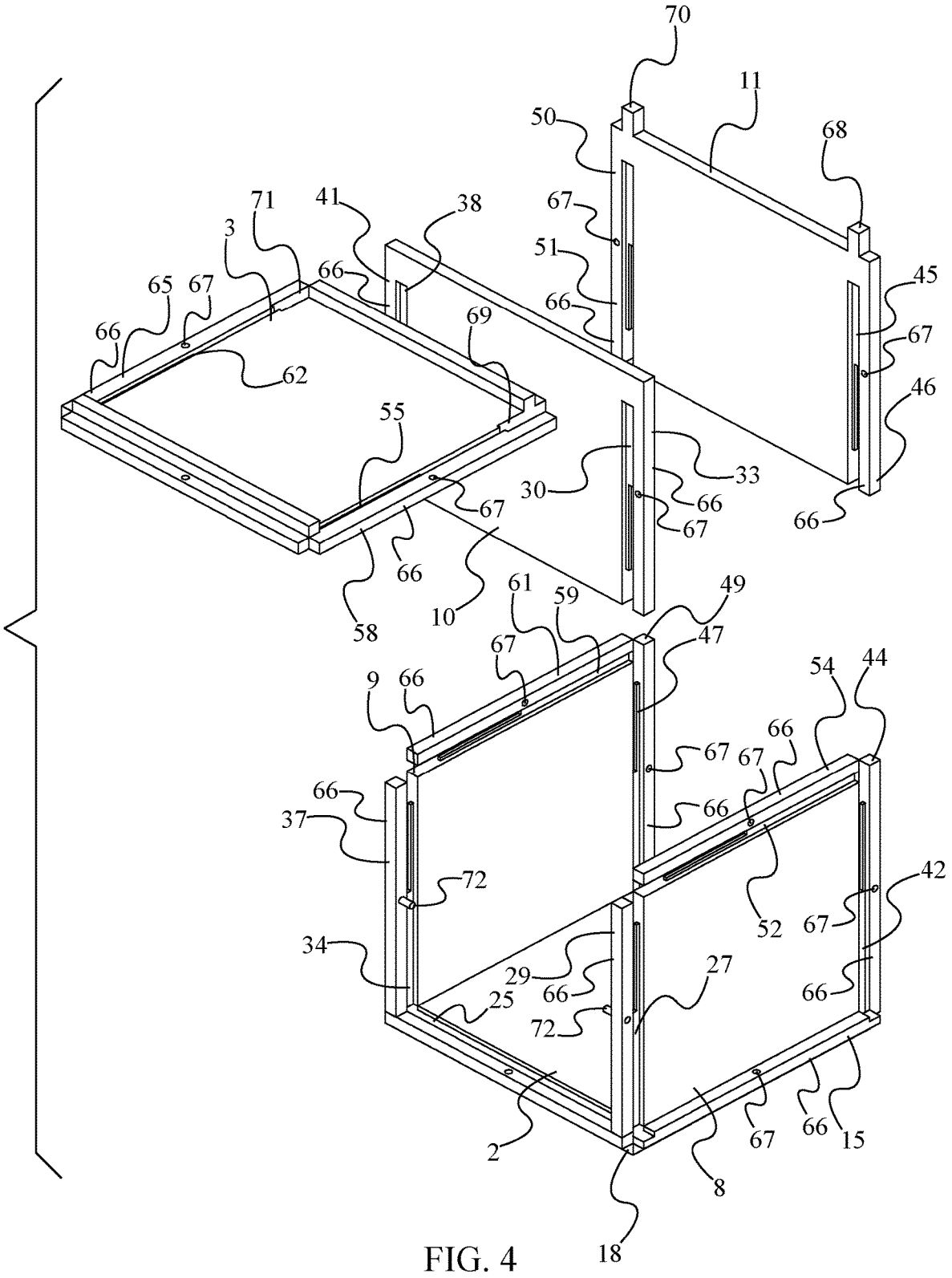
FIG. 4 is a partially exploded view of the present invention with the cover wall, a front wall, and a rear wall separated from a left wall and a right wall.
Figure 5:
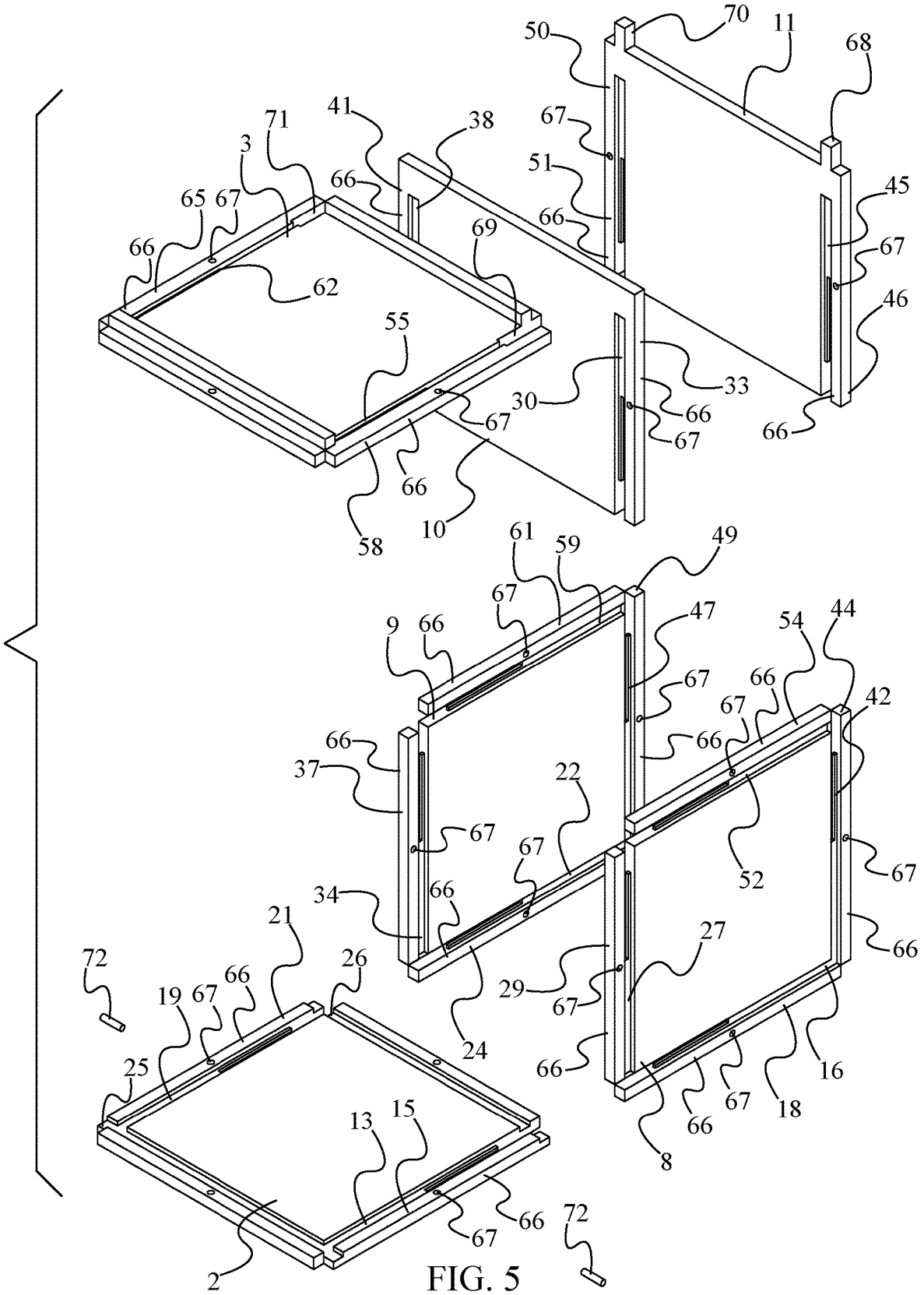
FIG. 5 is a fully exploded view of the present invention.
Figure 12:
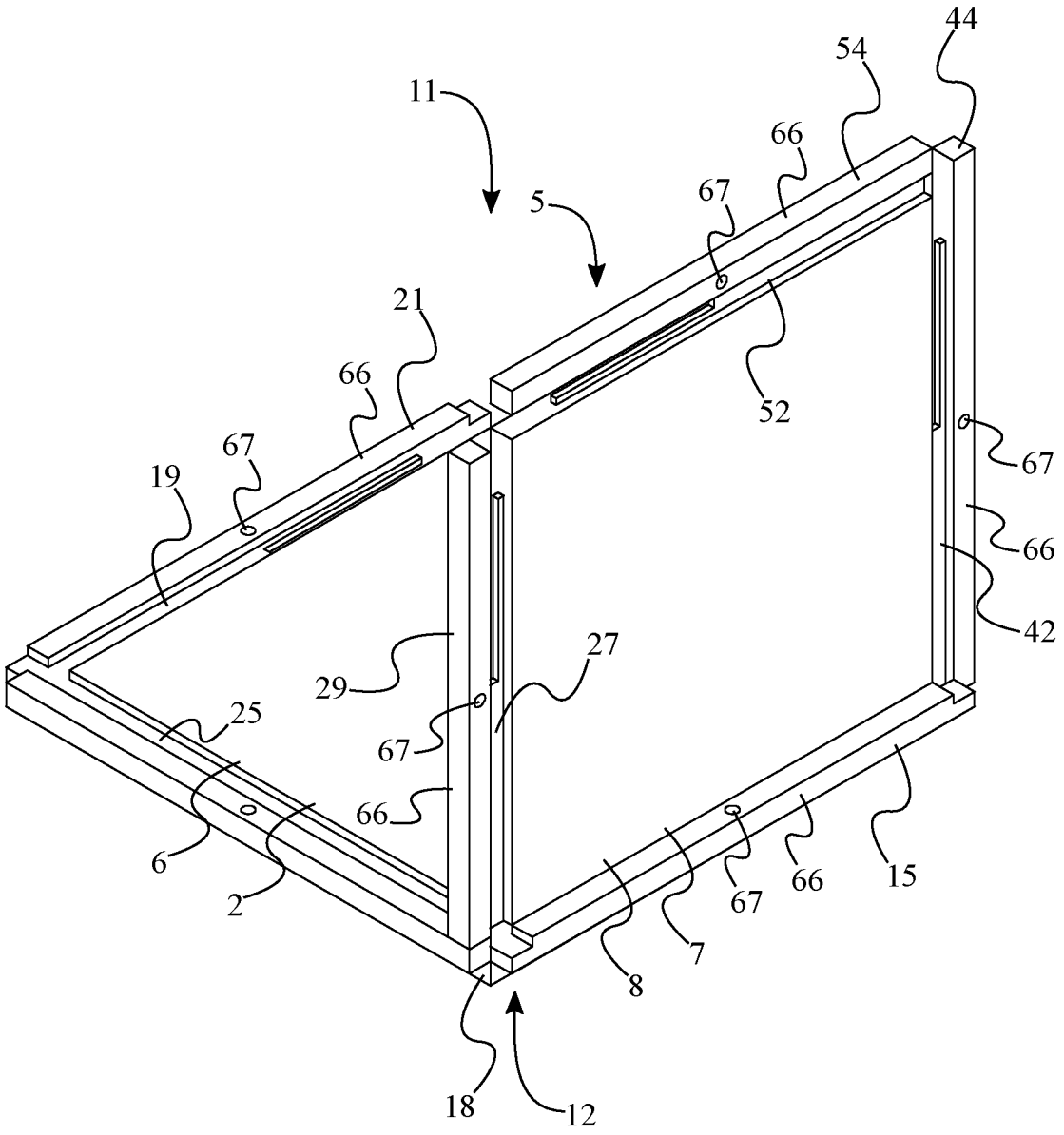
FIG. 12 is a perspective view of a pair of adjacent walls of the present invention.

In order for the plurality of lateral walls 4 to surround the base wall 2, the arbitrary wall 6 is the base wall 2, and the adjacent wall 7 is a left wall 8 from the plurality of lateral walls 4, seen in FIG. 4, FIG. 5, and FIG. 12. The interlocking mechanism 12 may comprise a first tongue-and-groove joint 13, a first elongated ledge 15, a second tongue-and-groove joint 16, and a second elongated ledge 18. The first tongue-and-groove joint 13 allows the left wall 8 to slide in and attach to the base wall 2 with the second tongue-and-groove joint 16. The first elongated ledge 15 structurally reinforces the connection between a tongue of the first tongue-and-groove joint 13 with that of a groove of the second tongue-and-groove joint 16. Likewise, the second elongated ledge 18 structurally reinforces the connection between a tongue of the second tongue-and-groove joint 16 with that of a groove of the first tongue-and-groove joint 13. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the first elongated ledge 15 and the second elongated ledge 18 uplifts and offsets the base wall 2 and the left wall 8, respectively, above the ground, depending if the base wall 2 or the left wall 8 is oriented towards the ground. Multiple records may be positioned within the present invention as the first tongue-and-groove joint 13 is peripherally connected to the base wall 2. The first elongated ledge 15 is externally positioned with the base wall 2 as the first elongated ledge 15 is connected adjacent and along the first tongue-and-groove joint 13, opposite to the base wall 2. Likewise, the second tongue-and-groove joint 16 is peripherally connected to the left wall 8, in order to define a cube-shape for the present invention. The second elongated ledge 18 is externally positioned with the left wall 8 as the second elongated ledge 18 is connected adjacent and along the second tongue-and-groove joint 16, opposite to the left wall 8. Multiple records may rest on the base wall 2 and be supported by the left wall 8 while positioned within the present invention as the first tongue-and-groove joint 13 is engaged into the second tongue-and-groove joint 16.

Furthermore, the arbitrary wall 6 is a base wall 2, and the adjacent wall 7 is a right wall 9 from the plurality of lateral walls 4, seen in FIG. 4 and FIG. 5. The interlocking mechanism 12 may comprise a third tongue-and-groove joint 19, a third elongated ledge 21, a fourth tongue-and-groove joint 22, and a fourth elongated ledge 24. The third tongue-and-groove joint 19 allows the right wall 9 to slide in and attach to the base wall 2 with the fourth tongue-and-groove joint 22. The third elongated ledge 21 structurally reinforces the connection between a tongue of the third tongue-and-groove joint 19 with a groove of the fourth tongue-and-groove joint 22. Likewise, the fourth elongated ledge 24 structurally reinforces the connection between a tongue of the fourth tongue-and-groove joint 22 with that of a groove of the third tongue-and-groove joint 19. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the third elongated ledge 21 and the fourth elongated ledge 24 uplifts and offset the base wall 2 and the right wall 9, respectively, above the ground, depending if the base wall 2 or the right wall 9 is oriented towards the ground. Multiple records may be positioned within the present invention as the third tongue-and-groove joint 19 is peripherally connected to the base wall 2. The third elongated ledge 21 is externally positioned with the base wall 2 as the third elongated ledge 21 is connected adjacent and along the third tongue-and-groove joint 19, opposite to the base wall 2. Likewise, the fourth tongue-and-groove joint 22 is peripherally connected to the right wall 9, in order to define a cube-shape for the present invention. The fourth elongated ledge 24 is externally positioned with the right wall 9 as the fourth elongated ledge 24 is connected adjacent and along the fourth tongue-and-groove joint 22, opposite to the right wall 9. Multiple records may rest on the base wall 2 and be supported by the left wall 8 while positioned within the present invention as the third tongue-and-groove joint 19 is engaged into the fourth tongue-and-groove joint 22.

Furthermore, the arbitrary wall 6 is the base wall 2, and the adjacent wall 7 is a front wall 10 from the plurality of lateral walls 4, seen in FIG. 4 and FIG. 5. The interlocking mechanism 12 may comprise a first edge-receiving groove 25. The first edge-receiving groove 25 allows the front wall 10 to remain flushed with both the left wall 8 and the right wall 9 while engaged with the left wall 8, the right wall 9, and the base wall 2. Moreover, the first edge-receiving groove 25 allows the additional length of the front wall 10 to maintain the exterior structure of the present invention across each of the plurality of box walls 1. In order for the base wall 2 to receive the front wall 10, the first edge-receiving groove 25 traverses into the base wall 2. The plurality of lateral walls 4 continuously surrounds the multiple records within the present invention as the first edge-receiving groove 25 is peripherally positioned with the base wall 2. The front wall 10 is engaged into the first edge-receiving groove 25, providing a flushed arrangement between the left wall 8, the right wall 9, and the front wall 10. This arrangement also allows the cover wall 3 to be evenly pressed against the left wall 8, the right wall 9, and the front wall 10.

Furthermore, the arbitrary wall 6 is the base wall 2, and the adjacent wall 7 is a rear wall 11 from the plurality of lateral walls 4, seen in FIG. 4 and FIG. 5. The interlocking mechanism 12 may comprise a second edge-receiving groove 26. The second edge-receiving groove 26 allows the rear wall 11 to remain flushed with both the left wall 8 and the right wall 9 while engaged with the left wall 8, the right wall 9, and the base wall 2. Moreover, the second edge-receiving groove 26 allows the additional length of the rear wall 11 to maintain the exterior structure of the present invention across each of the plurality of box walls 1. In order for the base wall 2 to receive the rear wall 11, the second edge-receiving groove 26 traverses into the base wall 2. The plurality of lateral walls 4 continuously surrounds the multiple records within the present invention as the second edge-receiving groove 26 is peripherally positioned with the base wall 2. The rear wall 11 is engaged into the second edge-receiving groove 26, providing a flushed arrangement between the left wall 8, the right wall 9, and the rear wall 11. This arrangement also allows the cover wall 3 to be evenly pressed against the left wall 8, the right wall 9, and the rear wall 11.

In order for the plurality of lateral walls 4 to be secured with one another, the arbitrary wall 6 is the left wall 8, and the adjacent wall 7 is a front wall 10 from the plurality of lateral walls 4, seen in FIG. 1, FIG. 2, FIG. 3, FIG. 4, FIG. 5, FIG. 13, and FIG. 14. The interlocking mechanism 12 may comprise a fifth tongue-and-groove joint 27, a fifth elongated ledge 29, a sixth tongue-and-groove joint 30, and a sixth elongated ledge 33. The fifth tongue-and-groove joint 27 allows the front wall 10 to slide in and attach to the left wall 8 with the sixth tongue-and-groove joint 30. The fifth elongated ledge 29 structurally reinforces the connection between a tongue of the fifth tongue-and-groove joint 27 with that of a groove of the sixth tongue-and-groove joint 30. Likewise, the sixth elongated ledge 33 structurally reinforces the connection between a tongue of the sixth tongue-and-groove joint 30 with that of a groove of the fifth tongue-and-groove joint 27. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the fifth elongated ledge 29 and the sixth elongated ledge 33 uplifts and offsets the left wall 8 and the front wall 10, respectively, above the ground, depending if the left wall 8 or the front wall 10 is oriented towards the ground. Multiple records may be positioned within the present invention as the fifth tongue-and-groove joint 27 is peripherally connected to the left wall 8. The fifth elongated ledge 29 is externally positioned with the left wall 8 as the fifth elongated ledge 29 is connected adjacent and along the fifth tongue-and-groove joint 27, opposite to the left wall 8. Likewise, the sixth tongue-and-groove joint 30 is peripherally connected to the front wall 10, in order to define a cube-shape for the present invention. The sixth elongated ledge 33 is externally positioned with the front wall 10 as the sixth elongated ledge 33 is connected adjacent and along the sixth tongue-and-groove joint 30, opposite to the front wall 10. Multiple records may rest on the left wall 8 and be supported by the front wall 10 while positioned within the present invention as the fifth tongue-and-groove joint 27 is engaged into the sixth tongue-and-groove joint 30.

Furthermore, the arbitrary wall 6 is the right wall 9, and the adjacent wall 7 is a front wall 10 from the plurality of lateral walls 4, seen in FIG. 1, FIG. 2, FIG. 3, FIG. 4, FIG. 5, FIG. 13, and FIG. 14. The interlocking mechanism 12 may comprise a seventh tongue-and-groove joint 34, a seventh elongated ledge 37, an eighth tongue-and-groove joint 38, and a eighth elongated ledge 41. The seventh tongue-and-groove joint 34 allows the front wall 10 to slide in and attach to the right wall 9 with the eighth tongue-and-groove joint 38. The seventh elongated ledge 37 structurally reinforces the connection between a tongue of the seventh tongue-and-groove joint 34 with that of a groove of the eighth tongue-and-groove joint 38. Likewise, the eighth elongated ledge 41 structurally reinforces the connection between a tongue of the eighth tongue-and-groove joint 38 with that of a groove of the seventh tongue-and-groove joint 34. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the seventh elongated ledge 37 and the eighth elongated ledge 41 uplifts and offsets the right wall 9 and the front wall 10, respectively, above the ground, depending if the right wall 9 or the front wall 10 is oriented towards the ground. Multiple records may be positioned within the present invention as the seventh tongue-and-groove joint 34 is peripherally connected to the right wall 9. The seventh elongated ledge 37 is externally positioned with the right wall 9 as the seventh elongated ledge 37 is connected adjacent and along the seventh tongue-and-groove joint 34, opposite to the right wall 9. Likewise, the eighth tongue-and-groove joint 38 is peripherally connected to the front wall 10, in order to define a cube-shape for the present invention. The eighth elongated ledge 41 is externally positioned with the front wall 10 as the eighth elongated ledge 41 is connected adjacent and along the eighth tongue-and-groove joint 38, opposite to the front wall 10. Multiple records may rest on the right wall 9 and be supported by the front wall 10 while positioned within the present invention as the seventh tongue-and-groove joint 34 is engaged into the eighth tongue-and-groove joint 38.

Furthermore, the arbitrary wall 6 is the left wall 8, and the adjacent wall 7 is a rear wall 11 from the plurality of lateral walls 4, seen in FIG. 1, FIG. 2, FIG. 3, FIG. 4, FIG. 5, FIG. 13, and FIG. 14. The interlocking mechanism 12 may comprise a ninth tongue-and-groove joint 42, a ninth elongated ledge 44, a tenth tongue-and-groove joint 45, and a tenth elongated ledge 46. The ninth tongue-and-groove joint 42 allows the rear wall 11 to slide in and attach to the left wall 8 with the tenth tongue-and-groove joint 45. The ninth elongated ledge 44 structurally reinforces the connection between a tongue of the ninth tongue-and-groove joint 42 with that of a groove of the tenth tongue-and-groove joint 45. Likewise, the tenth elongated ledge 46 structurally reinforces the connection between a tongue of the tenth tongue-and-groove joint 45 with that of a groove of the ninth tongue-and-groove joint 42. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the ninth elongated ledge 44 and the tenth elongated ledge 46 uplifts and offsets the left wall 8 and the rear wall 11, respectively, above the ground, depending if the left wall 8 or the rear wall 11 is oriented towards the ground. Multiple records may be positioned within the present invention as the ninth tongue-and-groove joint 42 is peripherally connected to the left wall 8. The ninth elongated ledge 44 is externally positioned with the left wall 8 as the ninth elongated ledge 44 is connected adjacent and along the ninth tongue-and-groove joint 42, opposite to the left wall 8. Likewise, the tenth tongue-and-groove joint 45 is peripherally connected to the rear wall 11, in order to define a cube-shape for the present invention. The tenth elongated ledge 46 is externally positioned with the rear wall 11 as the tenth elongated ledge 46 is connected adjacent and along the tenth tongue-and-groove joint 45, opposite to the rear wall 11. Multiple records may rest on the left wall 8 and be supported by the rear wall 11 while positioned within the present invention as the ninth tongue-and-groove joint 42 is engaged into the tenth tongue-and-groove joint 45.

Furthermore, the arbitrary wall 6 is the right wall 9, and the adjacent wall 7 is a rear wall 11 from the plurality of lateral walls 4, seen in FIG. 1, FIG. 2, FIG. 3, FIG. 4, FIG. 5, FIG. 13, and FIG. 14. The interlocking mechanism 12 may comprise an eleventh tongue-and-groove joint 47, an eleventh elongated ledge 49, a twelfth tongue-and-groove joint 50, and a twelfth elongated ledge 51. The eleventh tongue-and-groove joint 47 allows the rear wall 11 to slide in and attach to the right wall 9 with the twelfth tongue-and-groove joint 50. The eleventh elongated ledge 49 structurally reinforces the connection between a tongue of the eleventh tongue-and-groove joint 47 with that of a groove of the twelfth tongue-and-groove joint 50. Likewise, the twelfth elongated ledge 51 structurally reinforces the connection between a tongue of the twelfth tongue-and-groove joint 50 with that of a groove of the eleventh tongue-and-groove joint 47. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the eleventh elongated ledge 49 and the twelfth elongated ledge 51 uplifts and offsets the right wall 9 and the rear wall 11, respectively, above the ground, depending if the right wall 9 or the rear wall 11 is oriented towards the ground. Multiple records may be positioned within the present invention as the eleventh tongue-and-groove joint 47 is peripherally connected to the right wall 9. The eleventh elongated ledge 49 is externally positioned with the right wall 9 as the eleventh elongated ledge 49 is connected adjacent and along the eleventh tongue-and-groove joint 47, opposite to the right wall 9. Likewise, the twelfth tongue-and-groove joint 50 is peripherally connected to the rear wall 11, in order to define a cube-shape for the present invention. The twelfth elongated ledge 51 is externally positioned with the rear wall 11 as the twelfth elongated ledge 51 is connected adjacent and along the twelfth tongue-and-groove joint 50, opposite to the rear wall 11. Multiple records may rest on the right wall 9 and be supported by the rear wall 11 while positioned within the present invention as the eleventh tongue-and-groove joint 47 is engaged into the twelfth tongue-and-groove joint 50.

In order for the cover to enclose the multiple vinyl records within the present invention, the arbitrary wall 6 is the left wall 8, and the adjacent wall 7 is a cover wall 3 from the plurality of lateral walls 4, seen in FIG. 1, FIG. 2, FIG. 3, FIG. 13, and FIG. 14. The interlocking mechanism 12 may comprise a thirteenth tongue-and-groove joint 52, a thirteenth elongated ledge 54, a fourteenth tongue-and-groove joint 55, and a fourteenth elongated ledge 58. The thirteenth tongue-and-groove joint 52 allows the cover wall 3 to slide in and attach to the left wall 8 with the fourteenth tongue-and-groove joint 55. The thirteenth elongated ledge 54 structurally reinforces the connection between a tongue of the thirteenth tongue-and-groove joint 52 with that of a groove of the fourteenth tongue-and-groove joint 55. Likewise, the fourteenth elongated ledge 58 structurally reinforces the connection between a tongue of the fourteenth tongue-and-groove joint 55 with that of a groove of the thirteenth tongue-and-groove joint 52. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the thirteenth elongated ledge 54 and the fourteenth elongated ledge 58 uplifts and offsets the left wall 8 and the cover wall 3, respectively, above the ground, depending if the left wall 8 or the cover wall 3 is oriented towards the ground. Multiple records may be positioned within the present invention as the thirteenth tongue-and-groove joint 52 is peripherally connected to the left wall 8. The thirteenth elongated ledge 54 is externally positioned with the left wall 8 as the thirteenth elongated ledge 54 is connected adjacent and along the thirteenth tongue-and-groove joint 52, opposite to the left wall 8. Likewise, the fourteenth tongue-and-groove joint 55 is peripherally connected to the cover wall 3, in order to define a cube-shape for the present invention. The fourteenth elongated ledge 58 is externally positioned with the cover wall 3 as the fourteenth elongated ledge 58 is connected adjacent and along the fourteenth tongue-and-groove joint 55, opposite to the cover wall 3. Multiple records may rest on the left wall 8 and be supported by the cover wall 3 while positioned within the present invention as the thirteenth tongue-and-groove joint 52 is engaged into the fourteenth tongue-and-groove joint 55.

Furthermore, the arbitrary wall 6 is the right wall 9, and the adjacent wall 7 is a cover wall 3 from the plurality of lateral walls 4, seen in FIG. 1, FIG. 2, FIG. 3, FIG. 13, and FIG. 14 The interlocking mechanism 12 may comprise a fifteenth tongue-and-groove joint 59, a fifteenth elongated ledge 61, a sixteenth tongue-and-groove joint 62, and a sixteenth elongated ledge 65. The fifteenth tongue-and-groove joint 59 allows the cover wall 3 to slide in and attach to the right wall 9 with the sixteenth tongue-and-groove joint 62. The fifteenth elongated ledge 61 structurally reinforces the connection between a tongue of the fifteenth tongue-and-groove joint 59 with that of a groove of the sixteenth tongue-and-groove joint 62. Likewise, the sixteenth elongated ledge 65 structurally reinforces the connection between a tongue of the sixteenth tongue-and-groove joint 62 with that of a groove of the fifteenth tongue-and-groove joint 59. In the preferred embodiment of the present invention, the tongue traverses more than half of an overall length of the corresponding wall of the plurality of box walls 1, and the groove traverses to a midpoint of the overall length of the corresponding wall of the plurality of box walls 1. Moreover, the fifteenth elongated ledge 61 and the sixteenth elongated ledge 65 uplifts and offsets the right wall 9 and the cover wall 3, respectively, above the ground, depending if the right wall 9 or the cover wall 3 is oriented towards the ground. Multiple records may be positioned within the present invention as the fifteenth tongue-and-groove joint 59 is peripherally connected to the right wall 9. The fifteenth elongated ledge 61 is externally positioned with the right wall 9 as the fifteenth elongated ledge 61 is connected adjacent and along the fifteenth tongue-and-groove joint 59, opposite to the right wall 9. Likewise, the sixteenth tongue-and-groove joint 62 is peripherally connected to the cover wall 3, in order to define a cube-shape for the present invention. The sixteenth elongated ledge 65 is externally positioned with the cover wall 3 as the sixteenth elongated ledge 65 is connected adjacent and along the sixteenth tongue-and-groove joint 62, opposite to the cover wall 3. Multiple records may rest on the right wall 9 and be supported by the cover wall 3 while positioned within the present invention as the fifteenth tongue-and-groove joint 59 is engaged into the sixteenth tongue-and-groove joint 62.

Furthermore, the arbitrary wall 6 is a rear wall 11 from the plurality of lateral walls 4, and the adjacent wall 7 is a cover wall 3 from the plurality of lateral walls 4, seen in FIG. 1, FIG. 2, FIG. 3, FIG. 13, and FIG. 14. The interlocking mechanism 12 may comprise a first post 68, a first slot 69, a second post 70, and a second slot 71. The first post 68 and the second post 70 are peripherally connected to the rear wall 11. The first post 68 and the second post 70 not only maintain the exterior structure of the present invention across each of the plurality of box walls 1, but structurally reinforce the left wall 8 and the right wall 9 such that the structural integrity of the left wall 8 and the right wall 9 are preserved each time the cover wall 3 opens and closes with the plurality of lateral walls 4. The first slot 69 allows the cover wall 3 to continuously slide along the left wall 8 until the cover wall 3 is centrally positioned with the plurality of lateral walls 4. Likewise, the second slot 71 allows the cover wall 3 to continuously slide along the right wall 9 until the cover wall 3 is centrally positioned with the plurality of lateral walls 4. In order to accommodate the position of the left wall 8 and the right wall 9 across the rear wall 11, the first post 68 and the second post 70 are positioned offset from each other. The first post 68 and the second post 70 traverse through the cover wall 3 as the first slot 69 and the second slot 71 are peripherally integrated into the cover wall 3. As the first slot 69 receives the first post 68 and the second slot 71 receives the second post 70, the first slot 69 and the second slot 71 are positioned offset from each other. The first post 68 supports the left wall 8 as the cover slides along the left wall 8 and towards the rear wall 11 as the first post 68 is engaged into the first slot 69. The second post 70 supports the right wall 9 as the cover slides along the right wall 9 and towards the rear wall 11 as the second post 70 is engaged into the second slot 71.

Figure 6:
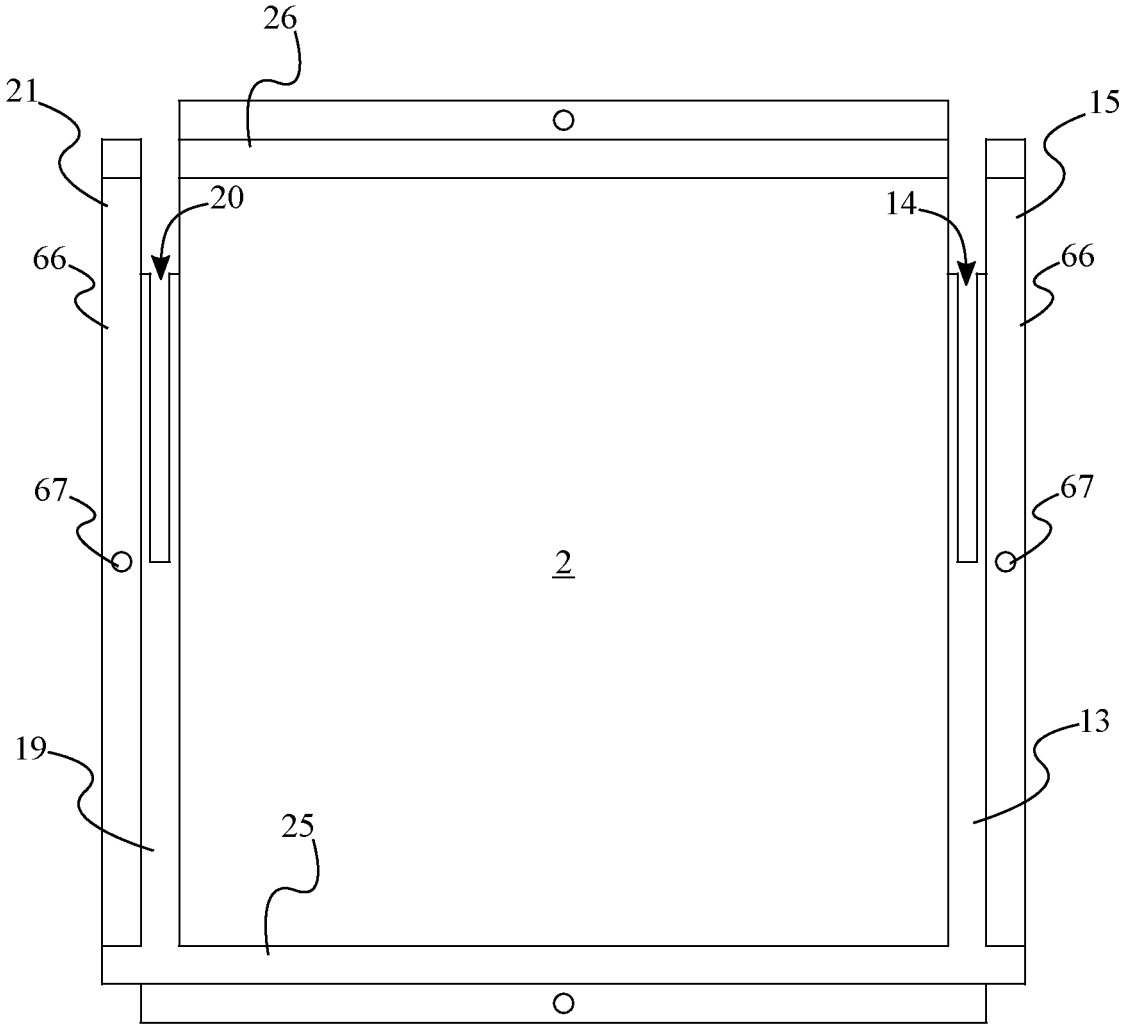
FIG. 6 is a side view of a base wall of the present invention.

In order for the plurality of lateral walls 4 to define a cube-shaped structure with the base wall 2, the interlocking mechanism 12 may comprise a first tongue-and-groove joint 13, a third tongue-and-groove joint 19, a first edge-receiving groove 25, and a second edge-receiving groove 26, seen in FIG. 6. The first tongue-and-groove joint 13 allows the left wall 8 to slide in and attach to the base wall 2, and the third tongue-and-groove joint 19 allows the right wall 9 to slide in and attach to the base wall 2. The first edge-receiving groove 25 allows the front wall 10 to remain flushed with both the left wall 8 and the right wall 9 while engaged with the left wall 8, the right wall 9, and the base wall 2. Likewise, the second edge-receiving groove 26 allows the rear wall 11 to remain flushed with both the left wall 8 and the right wall 9, while engaged with the left wall 8, the right wall 9, and the base wall 2. In order for the left wall 8 and the right wall 9 to be positioned parallel with each other, the first tongue-and-groove joint 13 and the third tongue-and-groove joint 19 are positioned opposite to each other across the base wall 2. Similarly, in order for the front wall 10 and the rear wall 11 to be positioned parallel with each other, the first edge-receiving groove 25 and the second edge receiving-groove are positioned opposite to each other across the base wall 2. The first edge-receiving groove 25 and the second edge-receiving groove 26 are positioned in between the first tongue-and-groove joint 13 and the third tongue-and-groove joint 19 so that the left wall 8 and the right wall 9 are positioned perpendicular with both the front wall 10 and the rear wall 11. More specifically, a receiving end 14 of the first tongue-and-groove joint 13 and a receiving end 20 of the third tongue-and-groove joint 19 are positioned adjacent to the second edge-receiving groove 26. The receiving end defines the direction for which an adjacent wall 7 slide in and connects with an arbitrary wall 6. This arrangement allows the left wall 8 and the right wall 9 to readily receive the front wall 10 and the rear wall 11 simultaneously.

Figure 7:
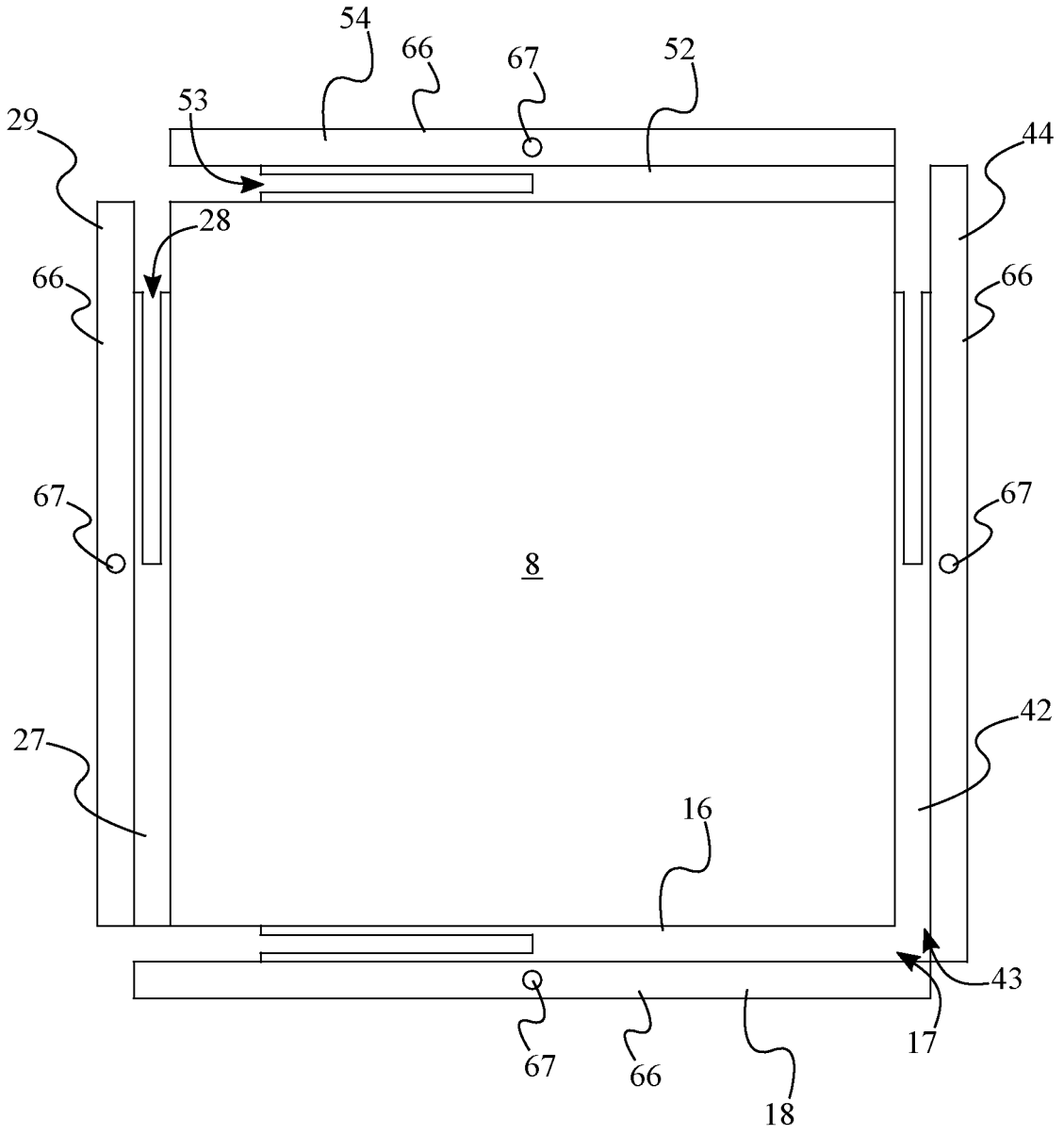
FIG. 7 is a side view of the left wall of the present invention.

In order for the left wall 8 to uphold each adjacent wall 7 of the plurality of lateral walls 4 while remaining connected with the base wall 2, the plurality of lateral walls 4 may comprise a left wall 8, and the interlocking mechanism 12 comprise a second tongue-and-groove joint 16, a fifth tongue-and-groove joint 27, a ninth tongue-and-groove joint 42, and a thirteenth tongue-and-groove joint 52, seen in FIG. 7. The second tongue-and-groove joint 16 allows the left wall 8 to connect with the base wall 2. The fifth tongue-and-groove joint 27 allows the front wall 10 to slide in and attach to the left wall 8. Likewise, the ninth tongue-and-groove joint 42 allows the rear wall 11 to slide in and attach to the left wall 8. The thirteenth tongue-and-groove joint 52 allows the cover wall 3 to slide in and enclose the plurality of lateral walls 4 and conceal the multiple records housed within the present invention. Furthermore, in the preferred embodiment of the present invention, the interlocking mechanism 12 may further comprise a seventeenth elongated ledge and an eighteenth elongated edge in order to further maintain the exterior structure of the present invention across each of the plurality of box walls 1. Moreover, the seventeenth elongated ledge presses with the fifth elongated ledge 29, and the eighteenth elongated edge presses with the tenth elongated ledge 46. The seventeenth elongated ledge and the eighteenth elongated ledge are positioned opposite to each other across the base wall 2 and are positioned in between the first tongue-and-groove joint 13 and the third tongue-and-groove joint 19. In order for the base wall 2 and the cover wall 3 to be positioned parallel with each other, the second tongue-and-groove joint 16 and the thirteenth tongue-and-groove joint 52 are positioned opposite to each other across the left wall 8. Similarly, in order for the front wall 10 and the rear wall 11 to be positioned parallel with each other, the fifth tongue-and-groove joint 27 and the ninth tongue-and-groove joint 42 are positioned opposite to each other across the left wall 8. The fifth tongue-and-groove joint 27 and the ninth tongue-and-groove joint 42 are positioned in between the second tongue-and-groove joint 16 and the thirteenth tongue-and-groove joint 52 so that the front wall 10 and the rear wall 11 are positioned perpendicular with both the base wall 2 and the cover wall 3. More specifically, a receiving end 28 of the fifth tongue-and-groove joint 27 and a receiving end 53 of the thirteenth tongue-and-groove joint 52 are positioned adjacent to each other. The receiving end defines the direction for which an adjacent wall 7 slides in and connects with an arbitrary wall 6. This arrangement connects the front wall 10 with the left wall 8 and allows the cover wall 3 to freely connect with the left wall 8 simultaneously. A stopping end 17 of the second tongue-and-groove joint 16 and a stopping end 43 of the ninth tongue-and-groove joint 42 are positioned adjacent to each other. The stopping end prevents the adjacent wall 7 from extending and sliding past the arbitrary wall 6. This arrangement allows the rear wall 11 to connect with the left wall 8, specifically in the same direction as that of the front wall 10 with the left wall 8. Moreover, the left wall 8 freely connects with the base wall 2.

Figure 8:
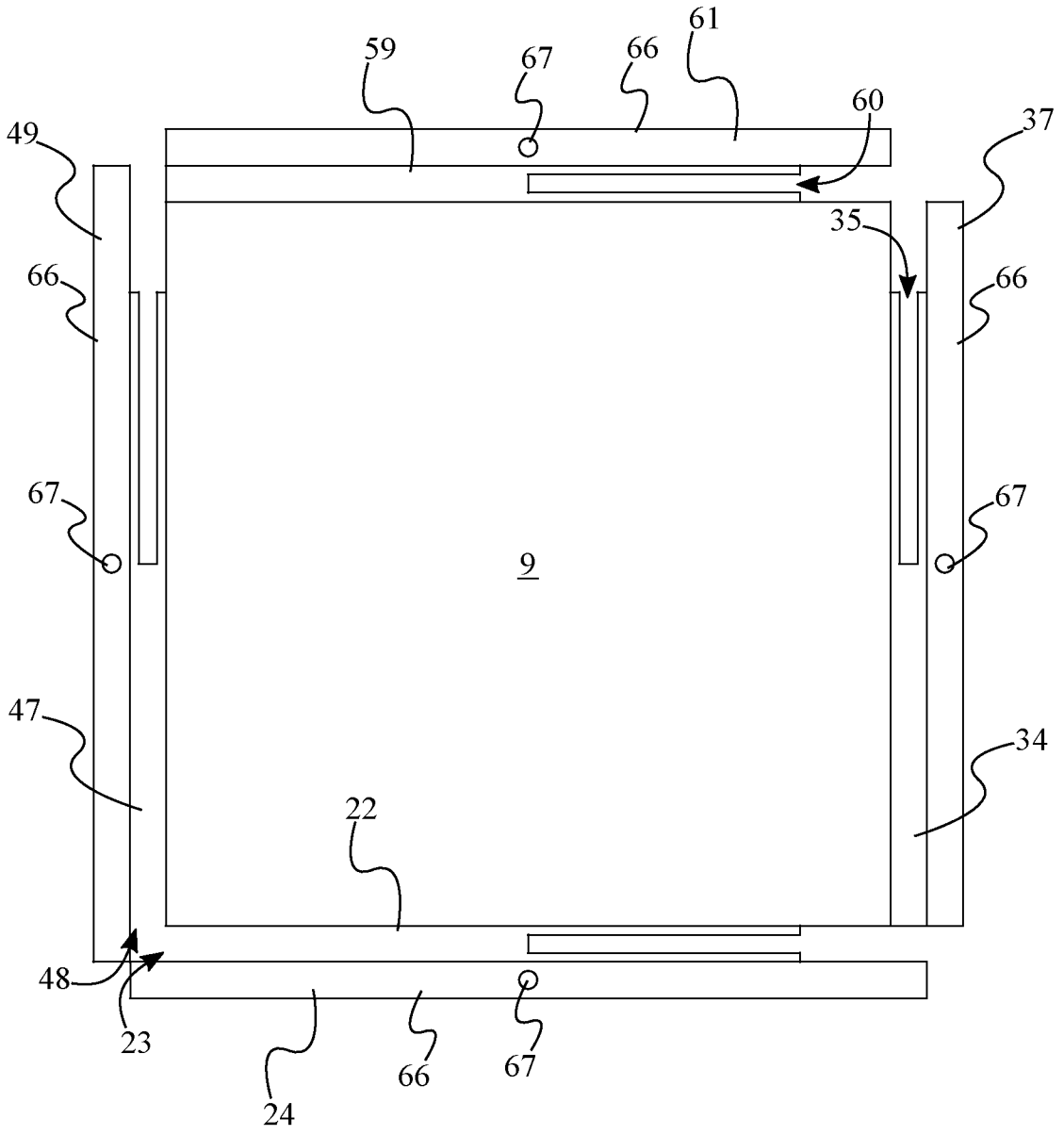
FIG. 8 is a side view of the right wall of the present invention.

Similarly, in order for the right wall 9 to uphold each adjacent wall 7 of the plurality of lateral walls 4 while remaining connected with the base wall 2, the plurality of lateral walls 4 may comprise a right wall 9, and the interlocking mechanism 12 comprise a fourth tongue-and-groove joint 22, a seventh tongue-and-groove joint 34, an eleventh tongue-and-groove joint 47, and a fifteenth tongue-and-groove joint 59, seen in FIG. 8. The fourth tongue-and-groove joint 22 allows the right wall 9 to connect with the base wall 2. The seventh tongue-and-groove joint 34 allows the front wall 10 to slide in and attach to the right wall 9. Likewise, the eleventh tongue-and-groove joint 47 allows the rear wall 11 to slide in and attach to the right wall 9. The fifteenth tongue-and-groove joint 59 allows the cover wall 3 to slide in and enclose the plurality of lateral walls 4 and conceal the multiple records housed within the present invention. Furthermore, in the preferred embodiment of the present invention, the interlocking mechanism 12 may further comprise a nineteenth elongated ledge and a twentieth elongated edge in order to further maintain the exterior structure of the present invention across each of the plurality of box walls 1. Moreover, the nineteenth elongated ledge presses with the seventh elongated ledge 37, and the twentieth elongated edge presses with the eleventh ledge 49. The nineteenth elongated ledge and the twentieth elongated ledge are positioned opposite to each other across the cover wall 3 and are positioned in between the fourteenth tongue-and-groove joint 55 and the sixteenth tongue-and-groove joint 62. In order for the base wall 2 and the cover wall 3 to be positioned parallel with each other, the fourth tongue-and-groove joint 22 and the fifteenth tongue-and-groove joint 59 are positioned opposite to each other across the right wall 9. Similarly, in order for the front wall 10 and the rear wall 11 to be positioned parallel with each other, the seventh tongue-and-groove joint 34 and the eleventh tongue-and-groove joint 47 are positioned opposite to each other across the right wall 9. The seventh tongue-and-groove joint 34 and the eleventh tongue-and-groove joint 47 are positioned in between the fourth tongue-and-groove joint 22 and the fifteenth tongue-and-groove joint 59 so that the front wall 10 and the rear wall 11 are positioned perpendicular with both the base wall 2 and the cover wall 3. More specifically, a receiving end 35 of the seventh tongue-and-groove joint 34 and a receiving end 60 of the fifteenth tongue-and-groove joint 59 are positioned adjacent to each other. The receiving end defines the direction for which an adjacent wall 7 slides in and connects with an arbitrary wall 6. This arrangement connects the front wall 10 with the right wall 9 and allows the cover wall 3 to freely connect with the right wall 9 simultaneously. A stopping end 23 of the fourth tongue-and-groove joint 22 and a stopping end 48 of the eleventh tongue-and-groove joint 47 are positioned adjacent to each other. The stopping end prevents the adjacent wall 7 from extending and sliding past the arbitrary wall 6. This arrangement allows the rear wall 11 to connect with the right wall 9, specifically in the same direction as that of the front wall 10 with the right wall 9. Moreover, the right wall 9 freely connects with the base wall 2.

Figure 10:
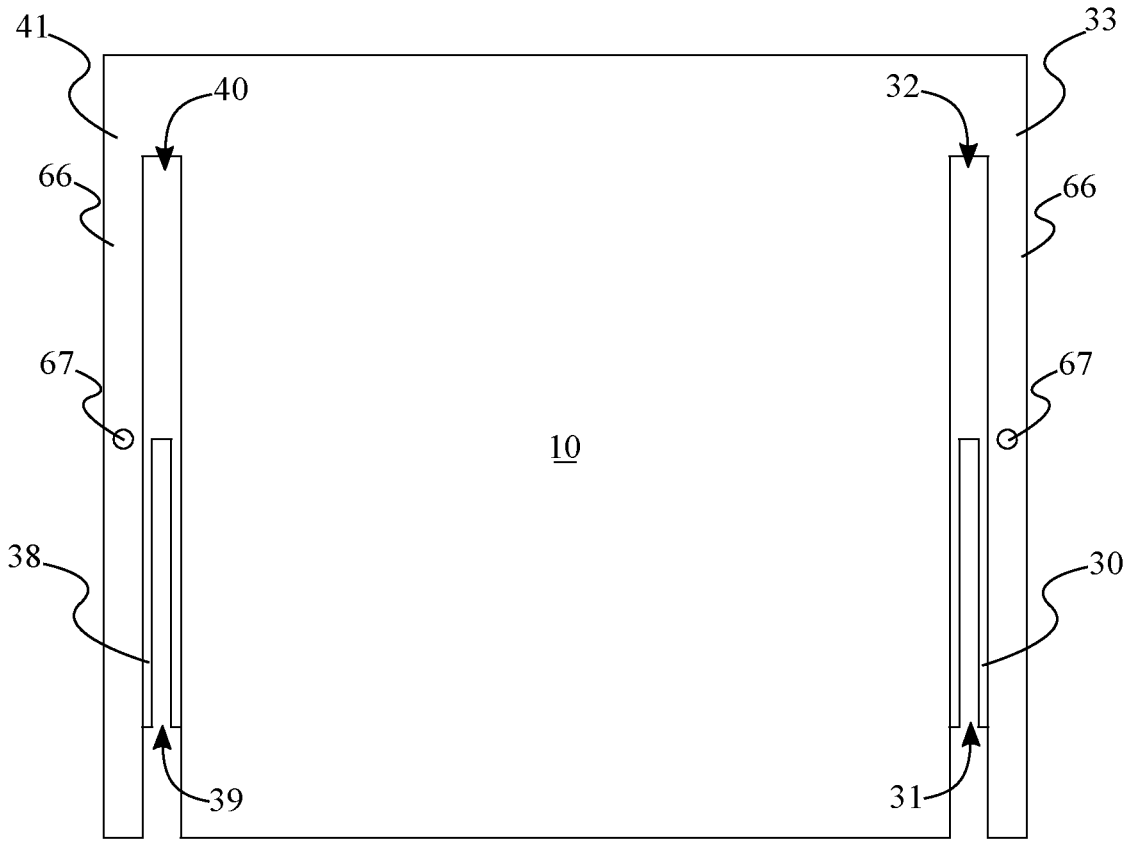
FIG. 10 is a side view of the front wall of the present invention.

In order for the front wall 10 to connect the left wall 8 and the right wall 9 with each other, the plurality of lateral walls 4 may comprise a front wall 10, and the interlocking mechanism 12 may comprise a sixth tongue-and-groove joint 30 and an eighth tongue-and-groove joint 38, seen in FIG. 10. The sixth tongue-and-groove joint 30 allows the front wall 10 to slide in and attach to the left wall 8. Likewise, the eighth tongue-and-grove joint allows the front wall 10 to slide in and attach to the right wall 9. In order for the left wall 8 and the right wall 9 to be positioned parallel with each other, the sixth tongue-and-groove joint and the eighth tongue-and-groove joint 38 are positioned opposite to each other across the front wall 10. The front wall 10 continuously and evenly connects with the left wall 8 and the right wall 9 simultaneously as a receiving end 31 of the sixth tongue-and-groove joint 30 and a receiving end 39 of the eighth tongue-and-groove joint 38 are positioned opposite to a stopping end 32 of the sixth tongue-and-groove joint 30 and a stopping end 40 of the eighth tongue-and-groove joint 38 across the front wall 10. The receiving end defines the direction for which an adjacent wall 7 slide in and connects with an arbitrary wall 6. The stopping end prevents the adjacent wall 7 from extending and sliding past the arbitrary wall 6.

Figure 9:
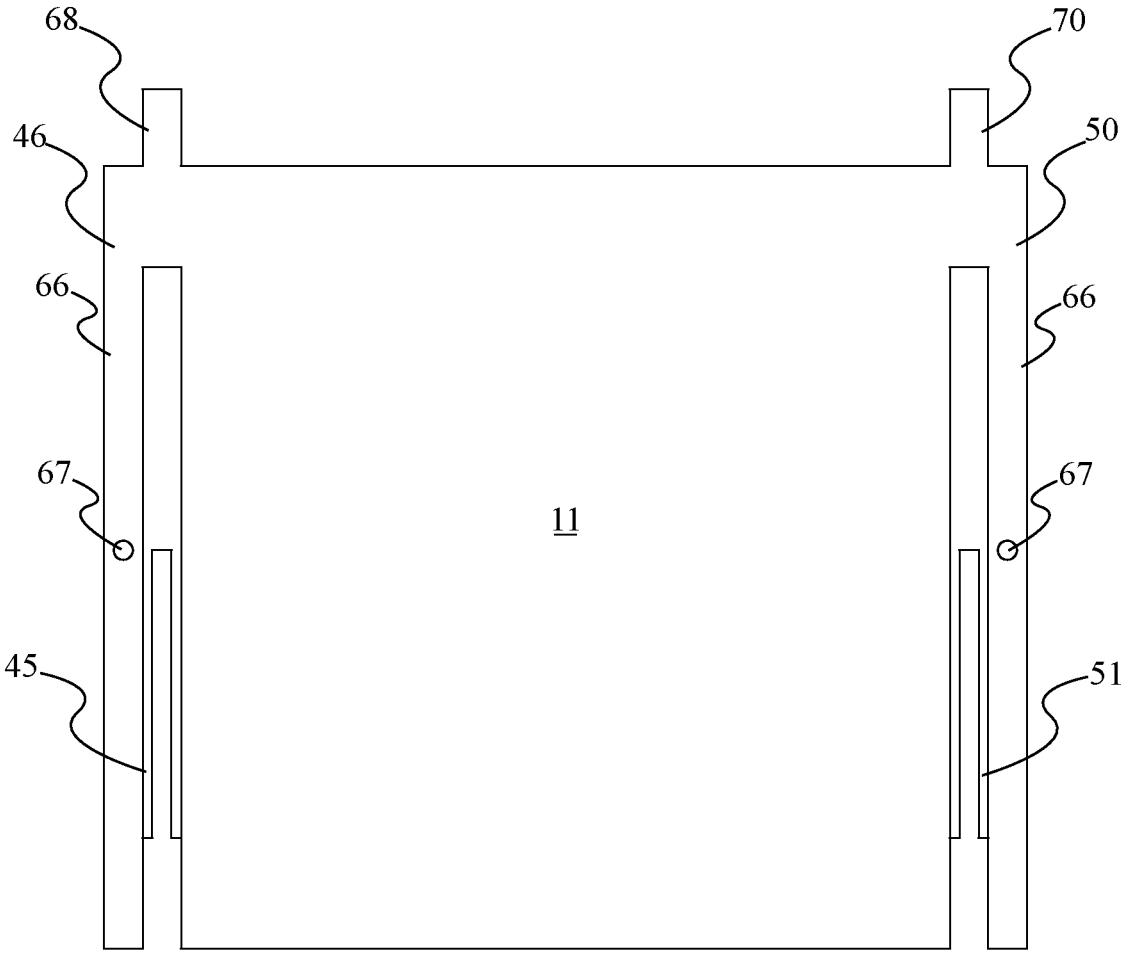
FIG. 9 is a side view of the rear wall of the present invention.

Similarly, in order for the rear wall 11 to connect the left wall 8 and the right wall 9 with each other, the plurality of lateral walls 4 may comprise a rear wall 11, and the interlocking mechanism 12 may comprise a tenth tongue-and-groove joint 45, a twelfth tongue-and-groove joint 50, a first post 68, and a second post 70, seen in FIG. 9. The first post 68 and the second post 70 not only maintain the exterior structure of the present invention across each of the plurality of box walls 1, but structurally reinforce the left wall 8 and the right wall 9 such that the structural integrity of the left wall 8 and the right wall 9 are preserved each time the cover wall 3 opens and closes with the plurality of lateral walls 4. The tenth tongue-and-groove joint 45 allows the rear wall 11 to slide in and attach to the right wall 9. Likewise, the twelfth tongue-and-groove joint 50 allows the rear wall 11 to slide in and attach to the right wall 9. In order for the left wall 8 and the right wall 9 to be positioned parallel with each other, the tenth tongue-and-groove joint 45 and the twelfth tongue-and-groove joint 50 are positioned opposite to each other across the rear wall 11. The rear wall 11 continuously and evenly connects with the left wall 8 and the right wall 9 as a receiving end 31 of the sixth tongue-and-groove joint 30 and a receiving end 39 of the eighth tongue-and-groove joint 38 are positioned opposite to a stopping end 32 of the sixth tongue-and-groove joint 30 and a stopping end 40 of the eighth tongue-and-groove joint 38 across the rear wall 11. The receiving end defines the direction for which an adjacent wall 7 slides in and connects with an arbitrary wall 6. The stopping end prevents the adjacent wall 7 from extending and sliding past the arbitrary wall 6. As the cover wall 3 is positioned adjacent with the stopping end 32 of the sixth tongue-and-groove joint 30, the first post 68 is positioned adjacent to the stopping end 32 of the sixth tongue-and-groove joint 30. Likewise, as the cover all is positioned adjacent with the stopping end 40 of the eighth tongue-and-groove joint 38, the second post 70 is positioned adjacent to the stopping end 40 of the eighth tongue-and-groove joint 38. The first post 68 and the second post 70 are positioned offset from each other.

Figure 11:
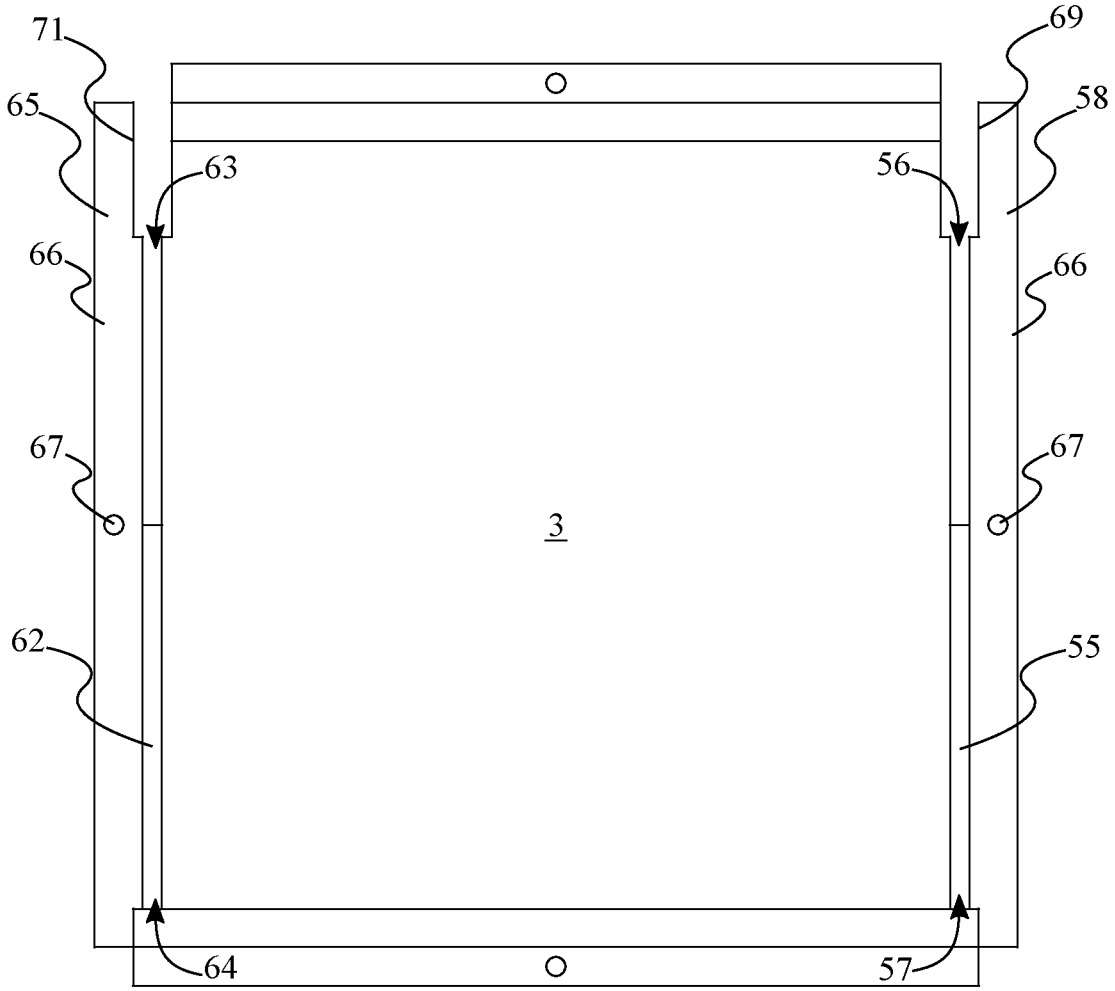
FIG. 11 is a side view of the cover wall of the present invention.

In order for the multiple records housed within the present invention to be readily accessible, the plurality of lateral walls 4 may comprise a cover wall 3, and the interlocking mechanism 12 may comprise a fourteenth tongue-and-groove joint 55, a sixteenth tongue-and-groove joint 62, a first slot 69, and a second slot 71, seen in FIG. 11. The fourteenth tongue-and-groove joint 55 allows the cover wall 3 to slide in and attach with the left wall 8. The sixteenth tongue-and-groove joint 62 allows the cover wall 3 to slide in and attach with the right wall 9. The first slot 69 allows the cover wall 3 to continuously slide along the left wall 8 until the cover wall 3 is centrally positioned with the plurality of lateral walls 4. Likewise, the second slot 71 allows the cover wall 3 to continuously slide along the right wall 9 until the cover wall 3 is centrally positioned with the plurality of lateral walls 4. Furthermore, in the preferred embodiment of the present invention, the interlocking mechanism 12 may further comprise a twenty-first elongated ledge and a twenty-second elongated edge in order to further maintain the exterior structure of the present invention across each of the plurality of box walls 1. Moreover, the twenty-first elongated ledge presses with the fifth elongated ledge 29, and the twenty-second elongated edge presses with the tenth elongated ledge 46. Furthermore, in the preferred embodiment of the present invention, the interlocking mechanism 12 may further comprise a twenty-third elongated ledge and a twenty-fourth elongated edge in order to further maintain the exterior structure of the present invention across each of the plurality of box walls 1. Moreover, the twenty-third elongated ledge presses with the seventh elongated ledge 37, and the twenty-fourth elongated edge presses with the eleventh ledge 49. In order to accommodate the parallel positioning of the left wall 8 with that of the right wall 9, the fourteenth tongue-and-groove joint 55 and the sixteenth tongue-and-groove joint 62 are positioned opposite to each other across the cover wall 3. A receiving end 56 of the fourteenth tongue-and-groove joint 55 and a receiving end 63 of the sixteenth tongue-and-groove joint 62 are positioned opposite to a stopping end 57 of the fourteenth tongue-and-groove joint 55 and a stopping end 64 of the sixteenth tongue-and-groove joint 62 across the cover wall 3. The receiving end defines the direction for which an adjacent wall 7 slides in and connects with an arbitrary wall 6. The stopping end prevents the adjacent wall 7 from extending and sliding past the arbitrary wall 6. As the rear wall 11 is positioned adjacent with the receiving end 56 of the fourteenth tongue-and-groove joint 55, the first slot 69 is integrated into the receiving end 56 of the fourteenth tongue-and-groove joint 55. Likewise, as the rear wall 11 is positioned adjacent with the receiving end 63 of the sixteenth tongue-and-groove joint 62, the second slot 71 is integrated into the receiving end 63 of the sixteenth tongue-and-groove joint 62.

In order to display a record casing along the exterior of the present invention, the present invention may further comprise at least one dowel 72, seen in FIG. 1, FIG. 2, FIG. 3, FIG. 4, FIG. 5, FIG. 12, FIG. 13, and FIG. 14. The at least one dowel 72 upholds a record casing against an arbitrary wall 6 of the plurality of box walls 1. The interlocking mechanism 12 may comprise a first elongated ledge 15, a second elongated ledge 18, a third elongated ledge 21, a fourth elongated ledge 24, a fifth elongated ledge 29, a sixth elongated ledge 33, a seventh elongated ledge 37, an eighth elongated ledge 41, a ninth elongated ledge 44, a tenth elongated ledge 46, an eleventh elongated ledge 49, a twelfth elongated ledge 51, a thirteenth elongated ledge 54, a fourteenth elongated ledge 58, a fifteenth elongated ledge 61, and a sixteenth elongated ledge 65, each of which structurally reinforces the connection between an arbitrary wall 6 and an adjacent wall 7. More specifically, the first elongated ledge 15, the second elongated ledge 18, the third elongated ledge 21, the fourth elongated ledge 24, the fifth elongated ledge 29, the sixth elongated ledge 33, the seventh elongated ledge 37, the eighth elongated ledge 41, the ninth elongated ledge 44, the tenth elongated ledge 46, the eleventh elongated ledge 49, the twelfth elongated ledge 51, the thirteenth elongated ledge 54, the fourteenth elongated ledge 58, the fifteenth elongated ledge 61, and the sixteenth elongated ledge 65 may each comprise a ledge body 66 and a setting hole 67. The ledge body 66 of an arbitrary wall 6 extends past an adjacent wall 7 such that a frame is defined for the adjacent wall 7 between an arbitrary ledge body 66 and an adjacent ledge body 66. The frame surrounds a record casing and conforms around the casing. The setting hole 67 defines a passage for the at least one dowel 72 and positions the at least one dowel 72 in front of a record casing positioned within a corresponding frame. Furthermore, in order for a frame to be defined across the base wall 2, the interlocking mechanism 12 may further comprise a twenty-fifth elongated ledge and a twenty-sixth elongated ledge. The twenty-fifth elongated ledge and a twenty-sixth elongated ledge are positioned opposite to each other across the base wall 2. Moreover, the twenty-fifth elongated ledge and the twenty-sixth elongated ledge are fixed adjacent with an external surface of the base wall 2. The external surface is oriented away from the plurality of lateral walls 4. Likewise, in order for a frame to be defined across the cover wall 3, the interlocking mechanism 12 may further comprise a twenty-seventh elongated ledge and a twenty-eighth elongated ledge. The twenty-seventh elongated ledge and a twenty-eighth elongated ledge are positioned opposite to each other across the cover wall 3. The external surface is oriented away from the plurality of lateral walls 4. Moreover, the twenty-seventh elongated ledge and the twenty-eighth elongated ledge are fixed adjacent with an external surface of the cover wall 3. The structural integrity of the ledge body 66 is preserved as the setting hole 67 laterally traverses through the ledge body 66. More specifically, the setting hole 67 is centrally positioned along the ledge body 66 as to better secure a record casing against an adjacent wall 7. The at least one dowel 72 being engaged into the setting hole 67 from at least one specific ledge, wherein the at least one specific ledge is selected from a group consisting of: the first elongated ledge 15, the second elongated ledge 18, the third elongated ledge 21, the fourth elongated ledge 24, the fifth elongated ledge 29, the sixth elongated ledge 33, the seventh elongated ledge 37, the eighth elongated ledge 41, the ninth elongated ledge 44, the tenth elongated ledge 46, the eleventh elongated ledge 49, the twelfth elongated ledge 51, the thirteenth elongated ledge 54, the fourteenth elongated ledge 58, the fifteenth elongated ledge 61, the sixteenth elongated ledge 65, and combinations thereof. This engagement secures the position of the at least one dowel 72 with a corresponding frame, consequently pressing the record casing positioned within the frame against the adjacent wall 7. In the preferred embodiment of the present invention, the at least one dowel 72 is a couple of dowels that are engaged through a couple of opposing setting holes associated with corresponding frame.

Figure 13:
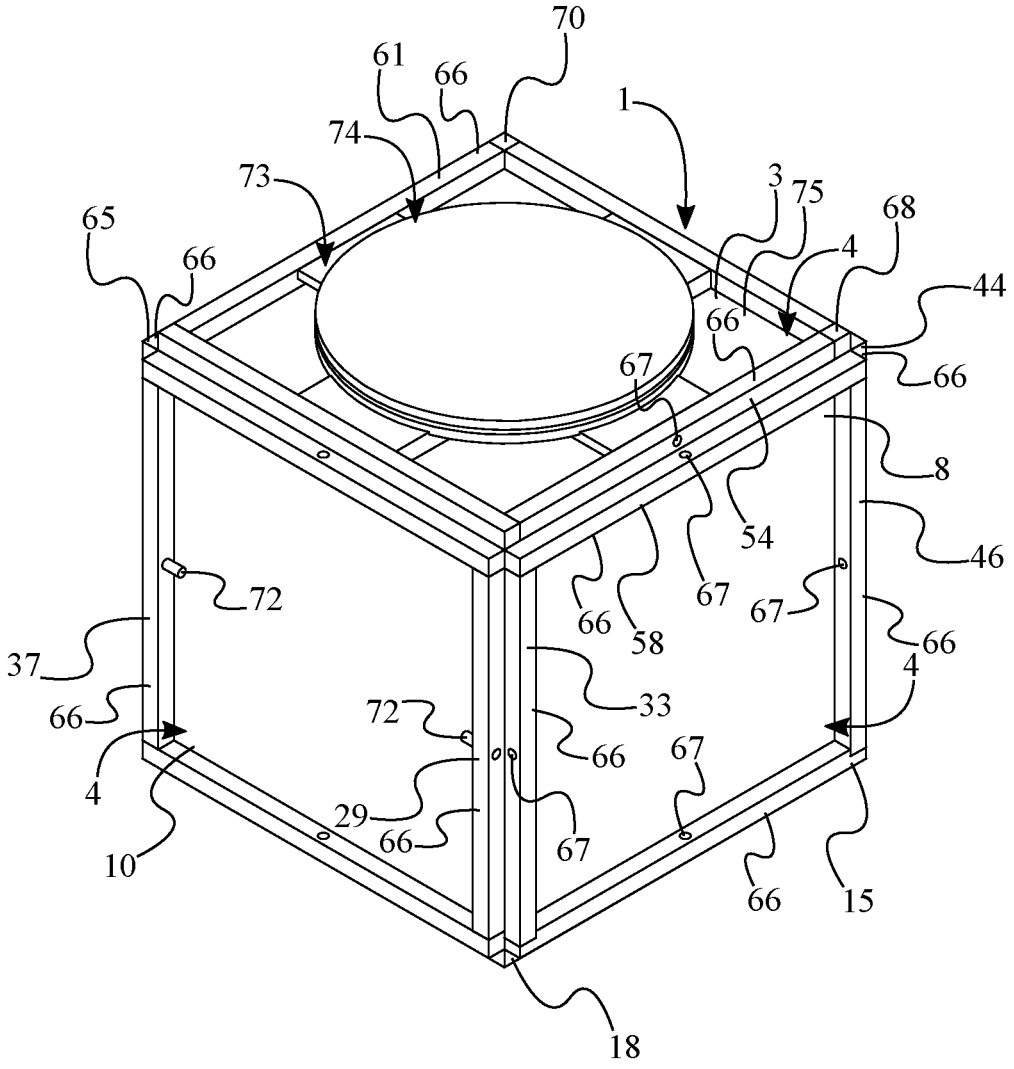
FIG. 13 is a perspective view of the present invention with a table adapter and a turntable.
Figure 14:
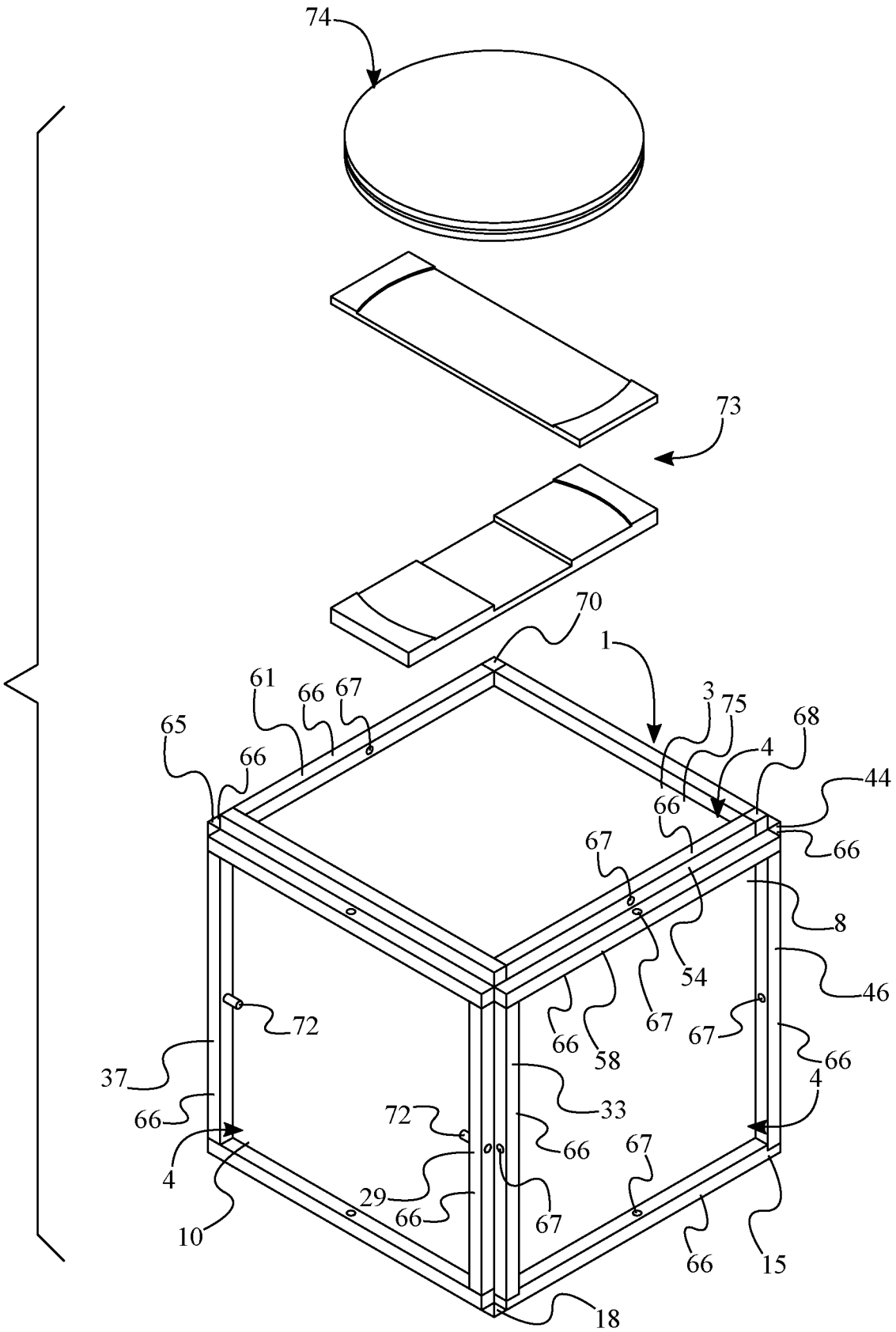
FIG. 14 is an exploded view of the present invention with the table adapter and the turntable separated from a plurality of box walls.

In order to easily view each displayed record casing across each visible wall of the plurality of walls and to easily access the cover wall 3 from any direction, the present invention may comprise a table adapter 73 and a turntable 74, seen in FIG. 13 and FIG. 14. The table adapter 73 connects the turntable 74 with the plurality of box walls 1. In the preferred embodiment of the present invention, the table adapter 73 may comprise a first crossbar, a second crossbar, and a turntable-receiving recess. The first crossbar and the second crossbar, together, secures the turntable 74 with the plurality of box walls 1. The turntable-receiving recess frictionally engages with a base the turntable 74 so that the turntable 74 with the first crossbar and the second crossbar. The first crossbar and the second crossbar are positioned adjacent with and perpendicular with each other. More specifically, the second crossbar is pressed within a cavity of the first crossbar so that the second crossbar is flushed with the first crossbar, and the turntable 74 evenly presses into the turntable-receiving recess. Moreover, the first crossbar and the second cross bar extend across a specific wall 75 of the plurality of box walls. The turntable 74 rotates the plurality of box walls 1 while fully attached with each other. In the preferred embodiment of the present invention, the turntable 74 is a "lazy Susan." However, it is understood that the turntable 74 may be a variety of other rotating trays in alternate embodiments of the present invention. In order for the present invention to be rotated on a surface, the table adapter 73 and the turntable 74 are externally positioned to the plurality of box walls 1. A specific wall 75 from the plurality of box walls 1 is mounted onto the turntable 74 by the adapter. The specific wall may be the base wall 2, the cover wall 3, or the plurality of lateral walls 4 that is oriented towards the ground.

Although the invention has been explained in relation to its preferred embodiment, it is to be understood that many other possible modifications and variations can be made without departing from the spirit and scope of the invention as hereinafter claimed.

What is claimed is:

1. A modular cube for a vinyl record comprising:

a plurality of box walls;

an interlocking mechanism;

the plurality of box walls comprising a base wall, a cover wall, and a plurality of lateral walls;

each pair of adjacent walls from the plurality of box walls comprises an arbitrary wall and an adjacent wall;

the plurality of lateral walls being positioned adjacent and perpendicular with the base wall;

the plurality of lateral walls being perimetrically distributed around the base wall;

the cover wall being positioned adjacent and perpendicular with the plurality of lateral walls, opposite to the base wall;

the arbitrary wall being detachably attached with adjacent wall by the interlocking mechanism;

at least one dowel;

the interlocking mechanism comprising a first elongated ledge, a second elongated ledge, a third elongated ledge, a fourth elongated ledge, a fifth elongated ledge, a sixth elongated ledge, a seventh elongated ledge, an eighth elongated ledge, a ninth elongated ledge, a tenth elongated ledge, an eleventh elongated ledge, a twelfth elongated ledge, a thirteenth elongated ledge, a fourteenth elongated ledge, a fifteenth elongated ledge, and a sixteenth elongated ledge;

the first elongated ledge, the second elongated ledge, the third elongated ledge, the fourth elongated ledge, the fifth elongated ledge, the sixth elongated ledge, the seventh elongated ledge, the eighth elongated ledge, the ninth elongated ledge, the tenth elongated ledge, the eleventh elongated ledge, the twelfth elongated ledge, the thirteenth elongated ledge, the fourteenth elongated ledge, the fifteenth elongated ledge, and the sixteenth elongated ledge each comprising a ledge body and a setting hole;

the setting hole laterally traversing through the ledge body;

the setting hole being centrally positioned along the ledge body;

the at least one dowel being engaged into the setting hole from at least one specific ledge, wherein the at least one specific ledge is selected from a group consisting of: the first elongated ledge, the second elongated ledge, the third elongated ledge, the fourth elongated ledge, the fifth elongated ledge, the sixth elongated ledge, the seventh elongated ledge, the eighth elongated ledge, the ninth elongated ledge, the tenth elongated ledge, the eleventh elongated ledge, the twelfth elongated ledge, the thirteenth elongated ledge, the fourteenth elongated ledge, the fifteenth elongated ledge, the sixteenth elongated ledge, and combinations thereof;

wherein regarding the dowel and setting hole, or dowels setting holes, the dowel(s) being engaged in the setting hole allow a vinyl record to be displayed on the modular cube.

2. The modular cube for a vinyl record as claimed in claim 1 comprising:

the interlocking mechanism comprising the arbitrary wall being the base wall;

the adjacent wall being a left wall from the plurality of lateral walls;

the interlocking mechanism comprising a first tongue-and-groove joint, the first elongated ledge, a second tongue-and-groove joint, and the second elongated ledge the first tongue-and-groove joint being peripherally connected to the base wall;

the first elongated ledge being connected adjacent and along the first tongue-and-groove joint, opposite to the base wall;

the second tongue-and-groove joint being peripherally connected to the left wall;

the second elongated ledge being connected adjacent and along the second tongue-and-groove joint, opposite to the left wall;

the first tongue-and-groove joint being engaged into the second tongue-and-groove joint.

3. The modular cube for a vinyl record as claimed in claim 1 comprising:

the arbitrary wall being the base wall;

the adjacent wall being a right wall from the plurality of lateral walls;

the interlocking mechanism comprising a third tongue-and-groove joint, the third elongated ledge, a fourth tongue-and-groove joint, and the fourth elongated ledge;

the third tongue-and-groove joint being peripherally connected to the base wall;

the third elongated ledge being connected adjacent and along the third tongue-and-groove joint, opposite to the base wall;

the fourth tongue-and-groove joint being peripherally connected to the right wall;

the fourth elongated ledge being connected adjacent and along the fourth tongue-and-groove joint, opposite to the right wall;

the third tongue-and-groove joint being engaged into the fourth tongue-and-groove joint.

4. The modular cube for a vinyl record as claimed in claim 1 comprising:

the arbitrary wall being the base wall;

the adjacent wall being a front wall from the plurality of lateral walls;

the interlocking mechanism comprising a first edge-receiving groove;

the first edge-receiving groove traversing into the base wall;

the first edge-receiving groove being peripherally positioned with the base wall;

the front wall being engaged into the first edge-receiving groove.

5. The modular cube for a vinyl record as claimed in claim 1 comprising:

the arbitrary wall being the base wall;

the adjacent wall being a rear wall from the plurality of lateral walls;

the interlocking mechanism comprising a second edge-receiving groove;

the second edge-receiving groove traversing into the base wall;

the second edge-receiving groove being peripherally positioned with the base wall;

the rear wall being engaged into the second edge-receiving groove.

6. The modular cube for a vinyl record as claimed in claim 1 comprising:

the arbitrary wall being a left wall from the plurality of lateral walls;

the adjacent wall being a front wall from the plurality of lateral walls;

the interlocking mechanism comprising a fifth tongue-and-groove joint, the fifth elongated ledge, a sixth tongue-and-groove joint, and the sixth elongated ledge the fifth tongue-and-groove joint being peripherally connected to the left wall;

the fifth elongated ledge being connected adjacent and along the fifth tongue-and-groove joint, opposite to the left wall;

the sixth tongue-and-groove joint being peripherally connected to the front wall;

the sixth elongated ledge being connected adjacent and along the sixth tongue-and-groove joint, opposite to the front wall;

the fifth tongue-and-groove joint being engaged into the sixth tongue-and-groove joint.

7. The modular cube for a vinyl record as claimed in claim 1 comprising:

the arbitrary wall being a right wall from the plurality of lateral walls;

the adjacent wall being a front wall from the plurality of lateral walls;

the interlocking mechanism comprising a seventh tongue-and-groove joint, the seventh elongated ledge, an eighth tongue-and-groove joint, and the eighth elongated ledge;

the seventh tongue-and-groove joint being peripherally connected to the right wall;

the seventh elongated ledge being connected adjacent and along the seventh tongue-and-groove joint, opposite to the right wall;

the eighth tongue-and-groove joint being peripherally connected to the front wall;

the eighth elongated ledge being connected adjacent and along the eighth tongue-and-groove joint, opposite to the front wall;

the seventh tongue-and-groove joint being engaged into the eighth tongue-and-groove joint.

8. The modular cube for a vinyl record as claimed in claim 1 comprising:

the arbitrary wall being a left wall from the plurality of lateral walls;

the adjacent wall being a rear wall from the plurality of lateral walls;

the interlocking mechanism comprising a ninth tongue-and-groove joint, the ninth elongated ledge, a tenth tongue-and-groove joint, and the tenth elongated ledge the ninth tongue-and-groove joint being peripherally connected to the left wall;

the ninth elongated ledge being connected adjacent and along the ninth tongue-and-groove joint, opposite to the left wall;

the tenth tongue-and-groove joint being peripherally connected to the rear wall;

the tenth elongated ledge being connected adjacent and along the tenth tongue-and-groove joint, opposite to the rear wall;

the ninth tongue-and-groove joint being engaged into the tenth tongue-and-groove joint.

9. The modular cube for a vinyl record as claimed in claim 1 comprising:

the arbitrary wall being a right wall from the plurality of lateral walls;

the adjacent wall being a rear wall from the plurality of lateral walls;

the interlocking mechanism comprising an eleventh tongue-and-groove joint, the eleventh elongated ledge, a twelfth tongue-and-groove joint, and the twelfth elongated ledge the eleventh tongue-and-groove joint being peripherally connected to the right wall;

the eleventh elongated ledge being connected adjacent and along the eleventh tongue-and-groove joint, opposite to the right wall;

the twelfth tongue-and-groove joint being peripherally connected to the rear wall;

the twelfth elongated ledge being connected adjacent and along the twelfth tongue-and-groove joint, opposite to the rear wall;

the eleventh tongue-and-groove joint being engaged into the twelfth tongue-and-groove joint.

10. The modular cube for a vinyl record as claimed in claim 1 comprising:

the arbitrary wall being a left wall from the plurality of lateral walls;

the adjacent wall being a cover wall from the plurality of lateral walls;

the interlocking mechanism comprising a thirteenth tongue-and-groove joint, the thirteenth elongated ledge, a fourteenth tongue-and-groove joint, and the fourteenth elongated ledge the thirteenth tongue-and-groove joint being peripherally connected to the left wall;

the thirteenth elongated ledge being connected adjacent and along the thirteenth tongue-and-groove joint, opposite to the left wall;

the fourteenth tongue-and-groove joint being peripherally connected to the cover wall;

the fourteenth elongated ledge being connected adjacent and along the fourteenth tongue-and-groove joint, opposite to the cover wall;

the thirteenth tongue-and-groove joint being engaged into the fourteenth tongue-and-groove joint.

11. The modular cube for a vinyl record as claimed in claim 1 comprising:

the arbitrary wall being a left wall from the plurality of lateral walls;

the adjacent wall being a cover wall from the plurality of lateral walls;

the interlocking mechanism comprising a fifteenth tongue-and-groove joint, the fifteenth elongated ledge, a sixteenth tongue-and-groove joint, and the sixteenth elongated ledge the fifteenth tongue-and-groove joint being peripherally connected to the right wall;

the fifteenth elongated ledge being connected adjacent and along the fifteenth tongue-and-groove joint, opposite to the right wall;

the sixteenth tongue-and-groove joint being peripherally connected to the cover wall;

the sixteenth elongated ledge being connected adjacent and along the sixteenth tongue-and-groove joint, opposite to the cover wall;

the fifteenth tongue-and-groove joint being engaged into the sixteenth tongue-and-groove joint.

12. The modular cube for a vinyl record as claimed in claim 1 comprising:

the arbitrary wall being a rear wall from the plurality of lateral walls;

the adjacent wall being a cover wall from the plurality of lateral walls;

the interlocking mechanism comprising a first post, a first slot, a second post, and a second slot;

the first post and the second post being peripherally connected to the rear wall;

the first post and the second post being positioned offset from each other;

the first slot and the second slot being peripherally integrated into the cover wall;

the first slot and the second slot being positioned offset from each other;

the first post being engaged into the first slot;

the second post being engaged into the second slot.

13. The modular cube for a vinyl record as claimed in claim 1 comprising:

the interlocking mechanism comprising a first tongue-and-groove joint, a third tongue-and-groove joint, a first edge-receiving groove, and a second edge-receiving groove;

the first tongue-and-groove joint and the third tongue-and-groove joint being positioned opposite to each other across the base wall;

the first edge-receiving groove and the second edge-receiving groove being positioned opposite to each other across the base wall;

the first edge-receiving groove and the second edge-receiving groove being positioned in between the first tongue-and-groove joint and the third tongue-and-groove joint;

a receiving end of the first tongue-and-groove joint and a receiving end of the third tongue-and-groove joint being positioned adjacent to the second edge-receiving groove.

14. The modular cube for a vinyl record as claimed in claim 1 comprising:

the plurality of lateral walls comprising a left wall;

the interlocking mechanism comprising a second tongue-and-groove joint, a fifth tongue-and-groove joint, a ninth tongue-and-groove joint, and a thirteenth tongue-and-groove joint;

the second tongue-and-groove joint and the thirteenth tongue-and-groove joint being positioned opposite to each other across the left wall;

the fifth tongue-and-groove joint and the ninth tongue-and-groove joint being positioned opposite to each other across the left wall;

the fifth tongue-and-groove joint and the ninth tongue-and-groove joint being positioned in between the second tongue-and-groove joint and the thirteenth tongue-and-groove joint;

a receiving end of the fifth tongue-and-groove joint and a receiving end of the thirteenth tongue-and-groove joint being positioned adjacent to each other;

a stopping end of the second tongue-and-groove joint and a stopping end of the ninth tongue-and-groove joint being positioned adjacent to each other.

15. The modular cube for a vinyl record as claimed in claim 1 comprising:

the plurality of lateral walls comprising a right wall;

the interlocking mechanism comprising a fourth tongue-and-groove joint, a seventh tongue-and-groove joint, an eleventh tongue-and-groove joint, and a fifteenth tongue-and-groove joint;

the fourth tongue-and-groove joint and the fifteenth tongue-and-groove joint being positioned opposite to each other across the right wall;

the seventh tongue-and-groove joint and the eleventh tongue-and-groove joint being positioned opposite to each other across the right wall;

the seventh tongue-and-groove joint and the eleventh tongue-and-groove joint being positioned in between the fourth tongue-and-groove joint and the fifteenth tongue-and-groove joint;

a receiving end of the seventh tongue-and-groove joint and a receiving end of the fifteenth tongue-and-groove joint being positioned adjacent to each other;

a stopping end of the fourth tongue-and-groove joint and a stopping end of the eleventh tongue-and-groove joint being positioned adjacent to each other.

16. The modular cube for a vinyl record as claimed in claim 1 comprising:

the plurality of lateral walls comprising a front wall;

the interlocking mechanism comprising a sixth tongue-and-groove joint and an eighth tongue-and-groove joint;

the sixth tongue-and-groove joint and the eighth tongue-and-groove joint being positioned opposite to each other across the front wall;

a receiving end of the sixth tongue-and-groove joint and a receiving end of the eighth tongue-and-groove joint being positioned opposite to a stopping end of the sixth tongue-and-groove joint and a stopping end of the eighth tongue-and-groove joint across the front wall.

17. The modular cube for a vinyl record as claimed in claim 1 comprising:

the plurality of lateral walls comprising a rear wall;

the interlocking mechanism comprising a tenth tongue-and-groove joint, a twelfth tongue-and-groove joint, a first post, and a second post;

the tenth tongue-and-groove joint and the twelfth tongue-and-groove joint being positioned opposite to each other across the rear wall;

a receiving end of the tenth tongue-and-groove joint and a receiving end of the twelfth tongue-and-groove joint being positioned opposite to a stopping end of the tenth tongue-and-groove joint and a stopping end of the twelfth tongue-and-groove joint across the rear wall;

the first post and the second post being positioned in between the stopping end of the tenth tongue-and-groove joint and the stopping end of the twelfth tongue-and-groove joint;

the first post and the second post being positioned offset from each other.

18. The modular cube for a vinyl record as claimed in claim 1 comprising:

the plurality of lateral walls comprising a cover wall;

the interlocking mechanism comprising a fourteenth tongue-and-groove joint, a sixteenth tongue-and-groove joint, a first slot, and a second slot;

the fourteenth tongue-and-groove joint and the sixteenth tongue-and-groove joint being positioned opposite to each other across the cover wall;

a receiving end of the fourteenth tongue-and-groove joint and a receiving end of the sixteenth tongue-and-groove joint being positioned opposite to a stopping end of the fourteenth tongue-and-groove joint and a stopping end of the sixteenth tongue-and-groove joint across the front wall;

the first slot being integrated into the receiving end of the fourteenth tongue-and-groove joint;

the second slot being integrated into the receiving end of the sixteenth tongue-and-groove joint.

19. The modular cube for a vinyl record as claimed in claim 1 comprising:

a table adapter;

a turntable;

the table adapter and the turntable being externally positioned to the plurality of box walls;

a specific wall from the plurality of box walls being mounted onto the turntable by the table adapter.

* * * * *